US007855330B2

(12) United States Patent
Lyles et al.

(10) Patent No.: US 7,855,330 B2
(45) Date of Patent: Dec. 21, 2010

(54) MODULAR BRIDGE FOR STRINGED MUSICAL INSTRUMENT

(75) Inventors: Cosmos Lyles, New York, NY (US); Paul Dowd, Scarsdale, NY (US)

(73) Assignee: Intune Technologies LLC, Los Angeles, CA (US)

( * ) Notice: Subject to any disclaimer, the term of this patent is extended or adjusted under 35 U.S.C. 154(b) by 0 days.

(21) Appl. No.: 12/356,051

(22) Filed: Jan. 19, 2009

(65) Prior Publication Data

US 2009/0183619 A1 Jul. 23, 2009

Related U.S. Application Data

(60) Provisional application No. 61/021,878, filed on Jan. 17, 2008.

(51) Int. Cl.
*G10D 3/10* (2006.01)

(52) U.S. Cl. ..... 84/297 R; 84/312 R

(58) Field of Classification Search ..... 84/297 R, 84/298, 299, 313, 312 R
See application file for complete search history.

(56) References Cited

U.S. PATENT DOCUMENTS

| | | | |
|---|---|---|---|
| 16,995 | A | 4/1857 | Ranle |
| 644,987 | A | 3/1900 | Lyon |
| 936,624 | A | 10/1909 | Hale |
| 1,113,390 | A | 10/1914 | Wenzel-Schmidt |
| 1,253,550 | A | 1/1918 | Wilkins |
| 1,416,568 | A | 5/1922 | Mazzocco |
| 1,626,753 | A | 5/1927 | Pecina et al. |
| 1,684,057 | A | 9/1928 | Fisher |
| 2,070,916 | A | 2/1937 | Peate |
| 2,130,248 | A | 9/1938 | Peate |
| 2,262,179 | A | 11/1941 | Hammond |

(Continued)

FOREIGN PATENT DOCUMENTS

| | | |
|---|---|---|
| JP | 2005173515 | 6/2005 |

(Continued)

OTHER PUBLICATIONS

Peters, Randall D., "Physics of the Zero-length Spring of Geoscience," http://physics.mercer.edu/earthwaves/zero.html, downloaded Sep. 10, 2008.

(Continued)

*Primary Examiner*—Jianchun Qin
(74) *Attorney, Agent, or Firm*—Knobbe, Martens, Olson & Bear, LLP

(57) ABSTRACT

A stringed musical instrument employs string tensioners to support and apply tension to corresponding musical strings. Each musical string is supported by one string tensioner, and each of the string tensioners is linearly movable independent of others of the string tensioners. Further, an adjustment mechanism is provided for selectively linearly moving each string tensioner. In a preferred embodiment, an effective playing length of each string is defined between the associated string tensioner and the nut of the instrument. As such, individual linear adjustment of the string tensioners enables the user to vary the playing length of the associated musical string. In other embodiments, a string tensioner is provided that supports a musical string from a position on a side of the string opposite the associated musical instrument surface.

16 Claims, 28 Drawing Sheets

U.S. PATENT DOCUMENTS

| | | | | |
|---|---|---|---|---|
| 2,453,572 | A | | 11/1948 | Ferrier |
| 2,514,835 | A | | 7/1950 | Bredice |
| 2,736,226 | A | | 2/1956 | McBride |
| 2,741,146 | A | | 4/1956 | Fender |
| 2,844,985 | A | * | 7/1958 | Ferriera ..... 84/312 R |
| 2,873,640 | A | | 2/1959 | Kunz |
| 2,973,682 | A | | 3/1961 | Fender |
| 3,136,198 | A | | 6/1964 | Smith et al. |
| 3,403,588 | A | | 10/1968 | Downing |
| 3,437,001 | A | | 4/1969 | Kraft |
| 3,575,078 | A | | 4/1971 | Currier |
| 3,580,525 | A | | 5/1971 | Dopner |
| 3,583,272 | A | | 6/1971 | Eurich |
| 3,584,807 | A | | 6/1971 | Smith |
| 3,667,336 | A | | 6/1972 | Itzler et al. |
| 3,688,631 | A | | 9/1972 | Jackson |
| 3,780,612 | A | | 12/1973 | Robinson |
| 3,924,820 | A | | 12/1975 | Kovar et al. |
| 4,120,462 | A | | 10/1978 | Raasch et al. |
| 4,129,154 | A | | 12/1978 | Bennelli |
| 4,130,045 | A | | 12/1978 | Walker |
| 4,137,812 | A | | 2/1979 | Franzmann |
| 4,138,919 | A | | 2/1979 | Miller |
| 4,161,903 | A | | 7/1979 | Sokol |
| 4,170,161 | A | | 10/1979 | Kaftan |
| 4,234,133 | A | | 11/1980 | Enneking |
| 4,348,934 | A | | 9/1982 | Ogata |
| 4,375,180 | A | | 3/1983 | Scholz |
| 4,426,907 | A | | 1/1984 | Scholz |
| 4,623,101 | A | | 11/1986 | Cacak |
| 4,656,915 | A | | 4/1987 | Osuga |
| 4,704,935 | A | | 11/1987 | Franklin |
| 4,760,622 | A | | 8/1988 | Rohrman |
| 4,762,046 | A | | 8/1988 | Aspri et al. |
| 4,856,404 | A | | 8/1989 | Hughes, Sr. |
| 4,876,794 | A | | 10/1989 | Meyers |
| 4,882,967 | A | | 11/1989 | Rose |
| 4,909,126 | A | | 3/1990 | Skinn et al. |
| 4,955,275 | A | | 9/1990 | Gunn |
| 5,040,741 | A | | 8/1991 | Brown |
| 5,080,295 | A | | 1/1992 | Hongo et al. |
| 5,095,797 | A | | 3/1992 | Zacaroli |
| 5,097,737 | A | | 3/1992 | Uhrig |
| 5,173,565 | A | | 12/1992 | Gunn |
| 5,277,373 | A | | 1/1994 | Morton |
| 5,284,396 | A | | 2/1994 | Masumura et al. |
| 5,293,804 | A | | 3/1994 | Myers |
| 5,323,680 | A | | 6/1994 | Miller et al. |
| 5,343,793 | A | | 9/1994 | Pattie |
| 5,359,144 | A | | 10/1994 | Benson |
| 5,377,926 | A | | 1/1995 | Min |
| 5,390,579 | A | | 2/1995 | Burgon |
| 5,413,019 | A | | 5/1995 | Blanda, Jr. |
| 5,477,765 | A | | 12/1995 | Dietzman |
| 5,567,895 | A | | 10/1996 | Aspri et al. |
| 5,637,820 | A | | 6/1997 | Wittman |
| 5,734,117 | A | | 3/1998 | Tanzella |
| 5,756,913 | A | | 5/1998 | Gilmore |
| 5,824,929 | A | | 10/1998 | Freeland et al. |
| 5,859,378 | A | | 1/1999 | Freeland et al. |
| 5,880,383 | A | * | 3/1999 | Huff ..... 84/313 |
| 5,886,270 | A | | 3/1999 | Wynn |
| RE36,484 | E | | 1/2000 | Turner |
| 6,034,311 | A | | 3/2000 | Fisher, IV |
| 6,069,306 | A | | 5/2000 | Isvan et al. |
| 6,084,166 | A | | 7/2000 | Lee |
| 6,283,397 | B1 | | 9/2001 | Chen |
| 6,384,311 | B1 | | 5/2002 | Cota |
| 6,420,639 | B1 | | 7/2002 | Sherlock |
| 6,437,226 | B2 | | 8/2002 | Oudshoorn et al. |
| 6,723,904 | B1 | | 4/2004 | Dolan et al. |
| 6,825,406 | B2 | | 11/2004 | Thidell |
| 7,235,729 | B2 | | 6/2007 | Minakuchi |
| 7,479,592 | B1 | | 1/2009 | Slavik |
| 7,534,950 | B2 | | 5/2009 | Lyles |
| 7,541,528 | B2 | | 6/2009 | Lyles |
| 7,554,023 | B2 | | 6/2009 | Tyler |
| 7,579,536 | B2 | | 8/2009 | Bonebrake |
| 7,592,528 | B2 | | 9/2009 | Lyles et al. |
| 7,632,997 | B2 | | 12/2009 | Small et al. |
| 7,692,079 | B2 | | 4/2010 | Lyles |
| 2003/0094087 | A1 | | 5/2003 | Gregory |
| 2003/0226441 | A1 | | 12/2003 | Barney |
| 2006/0117930 | A1 | | 6/2006 | Folmar et al. |
| 2007/0006712 | A1 | | 1/2007 | Lyles |
| 2007/0012161 | A1 | | 1/2007 | Lyles |
| 2007/0214931 | A1 | | 9/2007 | Lyles |
| 2007/0214935 | A1 | | 9/2007 | Lyles |
| 2007/0289429 | A1 | | 12/2007 | Tyler |
| 2008/0196571 | A1 | | 8/2008 | Lyles |
| 2009/0183619 | A1 | | 7/2009 | Lyles et al. |
| 2009/0301283 | A1 | | 12/2009 | Lyles et al. |

FOREIGN PATENT DOCUMENTS

| | | |
|---|---|---|
| WO | WO 00/38172 | 6/2000 |
| WO | WO2007/008785 | 1/2007 |
| WO | WO2007/106600 | 9/2007 |

OTHER PUBLICATIONS

Schmidt-Jones, Catherine, "Tuning Systems", Version 1.14: Dec. 8, 2006, http://cnx.org/content/m11639/latest.

* cited by examiner

MODULAR BRIDGE FOR STRINGED MUSICAL INSTRUMENT

CROSS-REFERENCE TO RELATED APPLICATIONS

This application is based on and claims the benefit of U.S. Provisional Application No. 61/021,878, which was filed on Jan. 17, 2008, the entirety of which is hereby incorporated by reference.

BACKGROUND OF THE INVENTION

1. Field of the Invention

The present invention relates to stringed musical instruments and components therefor.

2. Description of the Related Art

Stringed musical instruments create music when strings of the instrument vibrate at wave frequencies corresponding to desired musical notes. Such strings typically are held at a specified tension, and the musical tone emitted by the string is a function of the vibration frequency, length, tension, material and density of the string. In order to maintain the instrument in appropriate tune, these parameters must be maintained. Typically, musical strings go out of tune because of variation in string tension. Such tension changes commonly occur when, for example, the string stretches and slackens over time. Tension can also change due to atmospheric conditions such as temperature, humidity, and the like.

Tuning a stringed instrument is a process that can range from inconvenient to laborious. For example, tuning a piano typically is a very involved process that may take an hour or more. Tuning a guitar is not as complex; however, it is inconvenient and can interfere with play and/or performance.

SUMMARY OF THE INVENTION

Accordingly, there is a need in the art for a method and apparatus for mounting strings of a stringed musical instrument so that the instrument is more likely to maintain its correct tune, slower to go out of tune or maintaining tune indefinitely, easier and faster to place in tune, and so that retuning or adjusting the tune of the strings is easily and simply accomplished. There is also a need for a string instrument that will automatically adjust for string length changes without going out of tune.

In accordance with one embodiment, a stringed musical instrument is provided comprising a musical string having first and second ends, a first receiver adapted to receive the first end and hold the first end in an adjustably fixed position, and a string mounting system adapted to receive the second end. The string mounting system comprises a spring assembly configured to apply a tension to the second end of the string so as to hold the string at a perfect tune tension. The string mounting system is adapted so that as the second end of the musical string moves longitudinally over time due to string elongation or contraction, the string tension remains within a desired range defined about the perfect tune tension.

In accordance with one embodiment, the present invention provides a string mounting system for a stringed musical instrument that comprises a plurality of musical strings. The string mounting system comprises a plurality of string supports, each string support comprising a saddle and an anchor portion which are supported by a string support body. The saddle is configured to support a musical string. The anchor portion is configured to engage an anchor of a musical string so as to hold the string securely under tension. Each string support body comprises a mount portion that secures the associated string support to a musical instrument. The mount portion is configured so that a position of the string support on a musical instrument can be selectively linearly adjusted. The plurality of string supports are configured to be arranged generally side by side and independently linearly movable relative to one another. Linearly moving a string support selectively increases or decreases the effective playing length of a corresponding musical string.

In another such embodiment, the mount portion extends generally rearwardly from the string support body and is configured to accept a threaded bolt that also engages a portion of the musical instrument, and rotation of the threaded bolt changes the linear position of the mount portion.

In yet another embodiment the saddle is attached to a mechanical interface that is adapted to pivot relative to the string support body, and a spring is interposed between the mechanical interface and the body.

In one such embodiment, a first spring mount is disposed on the mechanical interface and a first end of the spring is attached to the first spring mount. The first spring mount is spaced from the pivot so that force exerted by the spring acts upon a moment arm relative to the pivot, and the moment arm changes as the mechanical interface rotates about the pivot.

In another embodiment, the first spring mount comprises a spring engagement surface, and the spring engagement surface comprises a material having a hardness of about 55-62 HRC. In still another embodiment the spring engagement surface is chrome plated. In a still further embodiment the first spring mount is selectively movable relative to the mechanical interface. In yet further embodiments, the first spring mount is elongate and threaded, and is configured to be threadingly attached to the mechanical interface, and the first spring mount is configured so that the space between the pivot and the spring engagement surface can be selectively increased or decreased by rotating the first spring mount.

In further embodiments, the saddle is configured to support the musical string on a side of the string opposite a surface of the musical instrument. In still further embodiments the anchor portion extends generally away from a surface of the musical instrument.

In yet another embodiment the spring engagement surface is defined by a first arc curving generally about a first axis and a second arc curving generally about a second axis transverse to the first, wherein the second arc translates along the first arc to define the spring engagement surface.

In accordance with another embodiment, a string mounting system is provided for a stringed musical instrument. The string mounting system comprises a string support comprising a saddle and an anchor portion that are supported by a string support body. The saddle is configured to support a musical string. The anchor portion is configured to engage an anchor of the musical string so as to hold the musical string securely under tension. The saddle is configured to support a musical string on a side of the string generally opposite a surface of the musical instrument. The anchor portion of the string support extends generally away from a surface of the musical instrument so that the anchor portion is disposed farther from the surface of the musical instrument than is the saddle.

In one such embodiment the string support is configured to be mounted onto a musical instrument without the string support penetrating a surface of the musical instrument. In another embodiment the string support is adapted to be mounted generally on or above a surface of a musical instrument.

In a further embodiment the saddle and the anchor portion are attached to a mechanical interface that is adapted to pivot relative to the string support body, and a spring is interposed between the mechanical interface and the body.

DETAILED DESCRIPTION OF PREFERRED EMBODIMENTS

The following description presents embodiments illustrating aspects of the present invention. It is to be understood that various types of musical instruments can be constructed using aspects and principles as described herein, and embodiments are not to be limited to the illustrated and/or specifically-discussed examples, but may selectively employ various aspects and/or principles disclosed in this application. For example, for ease of reference, embodiments are disclosed and depicted herein in the context of a six-string guitar. However, principles as discussed herein can be applied to other stringed musical instruments such as, for example, violins, harps, and pianos.

Figure 1:
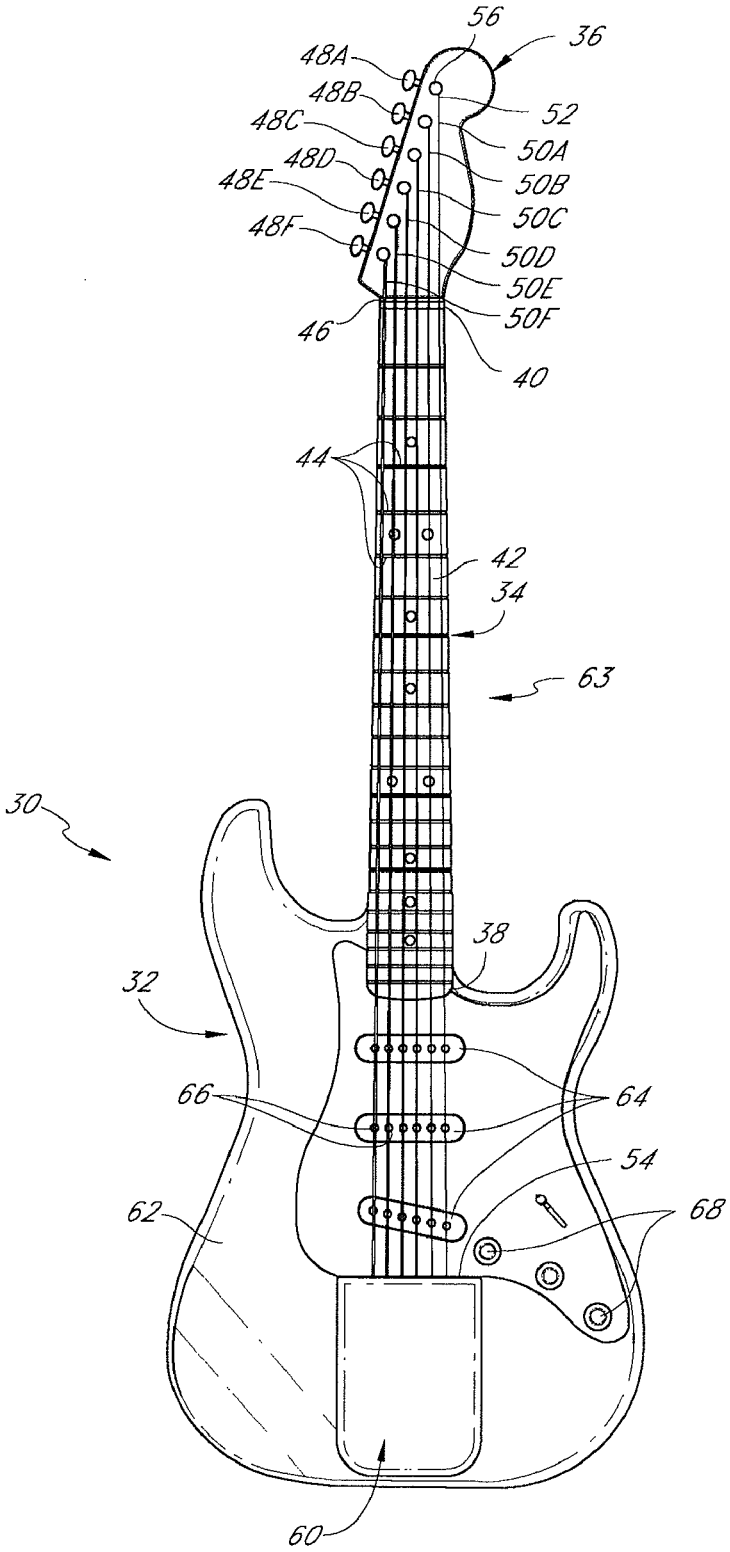
FIG. 1 shows an embodiment of a guitar employing a string mounting system depicted schematically and having aspects described herein.

With initial reference to FIG. 1, a guitar 30 is illustrated. The guitar 30 comprises a body 32, an elongate neck 34, and a head 36. A first end 38 of the neck 34 is attached to the body 32 and a second end 40 of the neck 34 is attached to the head 36. A fretboard 42 having a plurality of frets 44 is disposed on the neck 34, and a nut 46 is arranged generally at the point when the neck 34 joins with the head 36. Six tuning knobs 48A-F are disposed on the head 36. Six musical strings 50A-F are also provided, each having first and second ends 52, 54. The first end 52 of each string 50 is attached to an axle 56 of a corresponding tuning knob 48, and at least part of the string 50 is wrapped about the tuning knob axle 56. Each string 50 is drawn from the tuning knob 48 over the nut 46, and is suspended between the nut 46 and a string mounting system 60 disposed on a front face 62 of the body 32. The second end 54 of each musical string 50 is attached to the string mounting system 60.

In a conventional guitar, the string mounting system 60 comprises a stop having a plurality of slots generally corresponding to the strings. Preferably, the second end of each string includes a ball or the like that is configured to fit behind the slot so that the string ball is prevented from moving forwardly past the slot. A bridge usually is provided in front of the stop. By turning the tuning knobs a user tightens the strings so that they are suspended between the bridge and the nut. This suspended portion of the string 50, when vibrated, generates a musical note and can be defined as a playing zone 63 of the strings. The tuning knobs 48 are used to adjust string tension until the desired string tune is attained.

The illustrated embodiment is an electric guitar, and additionally provides a plurality of pickups 64, which include sensors 66 adapted to sense the vibration of the strings 50 and to generate a signal that can be communicated to an amplifier. Controllers 68 such as for volume control and the like are also depicted on the illustrated guitar 30.

In the embodiment illustrated in FIG. 1, the string mounting system 60 is depicted schematically. Applicants anticipate that string mounting systems having various structures can be employed with such a guitar 30.

Figure 2:
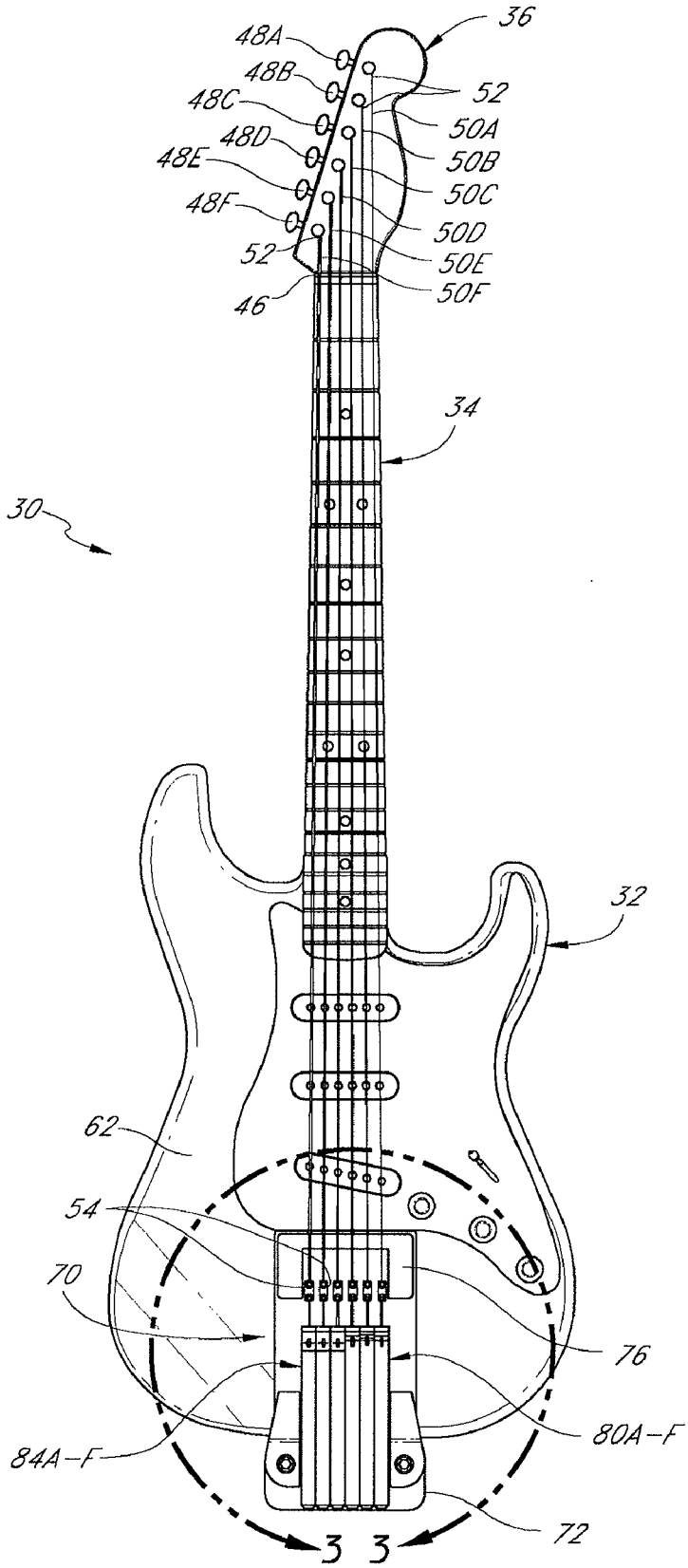
FIG. 2 shows an embodiment of a guitar employing an embodiment of a string mounting system having aspects of the present invention.

With reference next to FIG. 2, an embodiment of a guitar 30 having features substantially similar to the guitar depicted in FIG. 1 is illustrated. However, the illustrated guitar additionally includes an embodiment of a string mounting system 70 that includes springs 71 to tension the musical strings 50.

Figure 3:
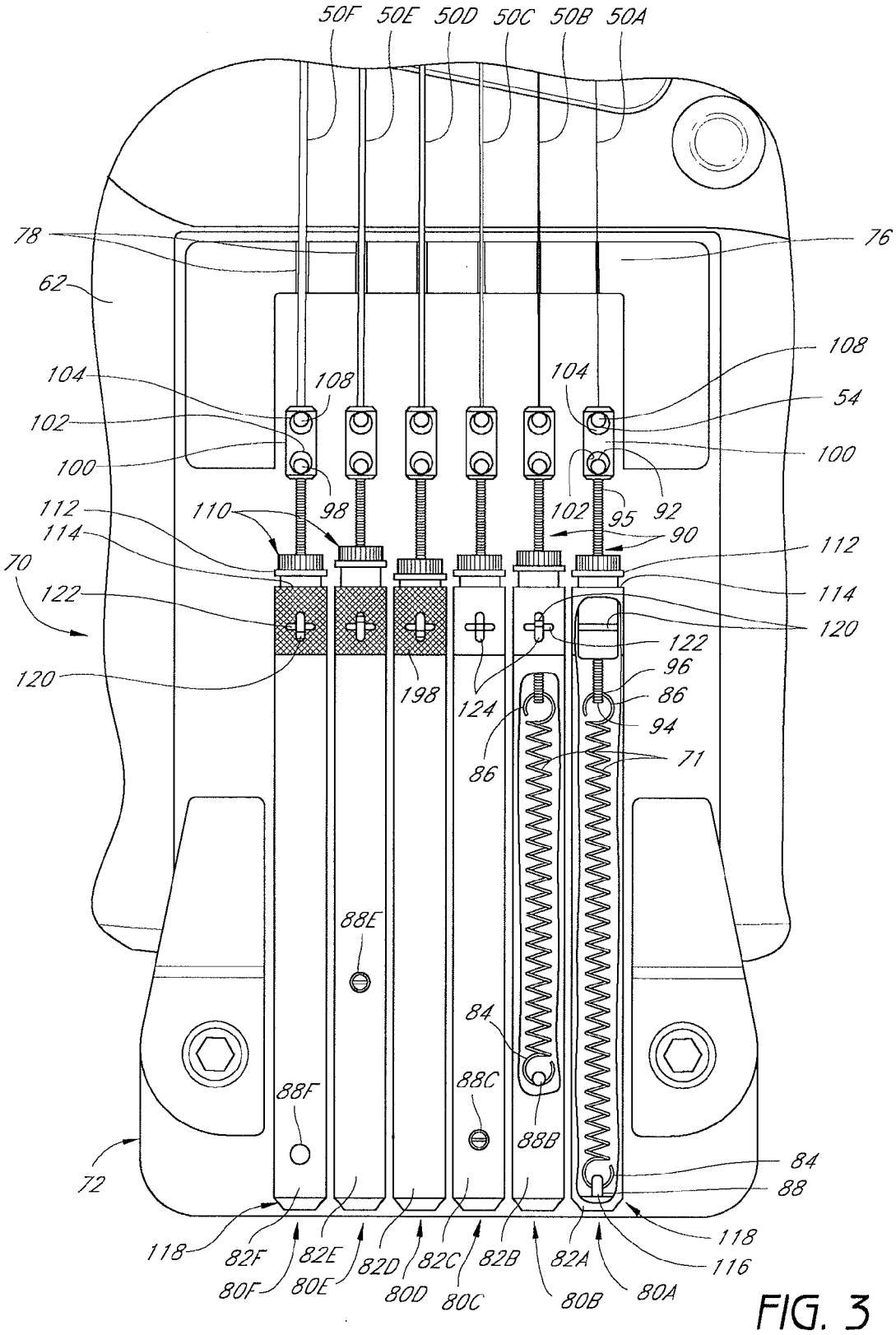
FIG. 3 is a close up view of the guitar of FIG. 2 taken along lines 3-3, and showing portions of the string mounting system partially cutaway.
Figure 4:
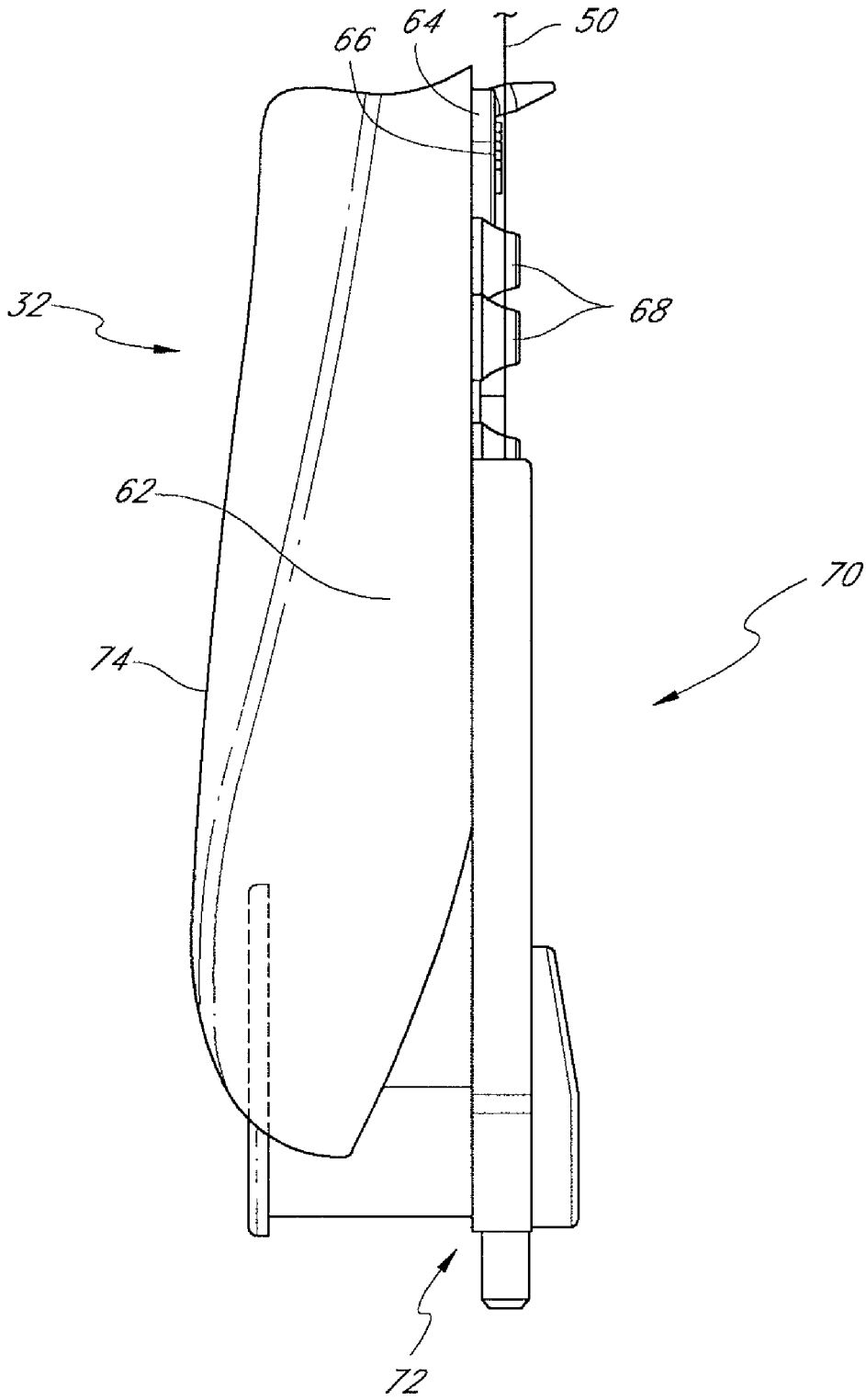
FIG. 4 is a side view of the portion of the guitar shown in FIG. 3.

With more particular reference to FIGS. 3-4, the illustrated string mounting system 70 includes a frame 72 that is mounted onto the guitar body 32. The frame 72 grasps both the front face 62 and a back 74 of the guitar body 32. The illustrated system 70 comprises a bridge 76 having string tracks or saddles 78 adapted to accommodate corresponding strings 50.

With specific reference to FIG. 3, the illustrated string mounting system 70 includes a plurality of spring assemblies 80A-F, each assembly dedicated to secure a corresponding musical string 50A-F. Each spring assembly 80 includes a spring holder or tube 82 that generally encloses a spring 71. Each elongate spring 71 has a first end 82 and a second end 86. A base connector 88 is provided along the length of the spring tube 82, and the first end 84 of the spring 71 is attached to the base connector 88. An elongate spring connector 90 also has a first end 92, a second end 94, and an elongate body 95 therebetween. The second end 94 of the spring connector 90 preferably comprises an aperture 96 or the like to facilitate connecting to the second end 86 of the spring 71, preferably within the tube 82. The first end 92 of the spring connector 90 preferably comprises a ball, disc or other mechanical interface structure 98 having an expanded width relative to the body 95.

A plurality of string holders 100 are provided, each having two receivers 102, 104. A first receiver 192 is adapted to engage the ball 98 on the first end 94 of the spring connector 90. A second receiver 104 of each string holder 100 is adapted to receive and secure a ball connector 108 on the second end 54 of the respective musical string 50. As such, the string holder 100 connects a musical string 50 to the spring connector 90, and the spring connector 90 connects the string holder 100 to the spring 71. Thus, each spring 71 is mechanically connected to a corresponding musical string 50 so that spring tension is communicated to the string 50. In this embodiment, the connection is achieved by a mechanical interface that includes the spring connector 90 and string holder 100. It is to be understood that, in other embodiments, mechanical interfaces having different structural characteristics may be used to connect the string 50 to the spring 71.

An elongate stop 110 is provided on and attached to each elongate spring connector 90. Preferably, each stop 110 includes a ridge 112 sized and adapted to engage an end 114 of the corresponding spring tube 82 when the corresponding string 50 is slack or unconnected. As such, the spring 71 is kept in a pre-stressed condition, even when the corresponding musical string 50 is slack or not attached. Since the spring is already pre-stressed when the string 50 is connected when stringing the instrument, it is relatively quickly and easily tightened to string tension corresponding to correct tune. Thus, quick initial tuning is facilitated by this structure.

Preferably, each spring 71 is chosen and arranged so that its pre-stressed condition is close to, but not less than, the nominal tension associated with the corresponding string's proper tuning. For instance, if the string 50 is properly tuned at a tension of 17 lb., the pre-stressed condition of the spring 71 preferably is greater than about 15 lbs., and may be almost 17 lbs. Preferably, the pre-stressed condition is within about 25% of the proper tuning tension. More preferably, the pre-stressed condition is within about 10% of the proper tuning tension. Even more preferably, the pre-stressed condition is within about 5% of the proper tuning tension.

Properly pre-stressing the spring 71 may be accomplished in various ways. For example, in the illustrated embodiment, the first end 84 of each spring 71 is attached to its corresponding base connector 88 arranged in the tube 82. The base connector 88 is placed along the length of the tube 82 so that when the first end 84 of the spring 71 is attached to the base connector 88 and the second end 86 of the spring 71 is attached to the spring connector 90, the spring 71 is maintained at its appropriate pre-stressed tension. In a preferred embodiment, the position of each base connector 88 is chosen so that the corresponding spring 71 is placed in a desired pre-stressed tension when connected. It is to be understood, however, that other factors may also be varied. For example, in addition to or instead of varying the position of the base connector 88, varying characteristics of the spring, such as using a spring having a special chosen spring rate, may customize the spring arrangement for specific corresponding strings.

In the illustrated embodiment, the base connectors 88B, 88C, 88E comprise screws driven through the tubes 82 at desired locations. In additional embodiments, the base connectors may have different structures. For example, base connector 88F is a rod extending through the tube 82. In other embodiments, such base connector structures may be attached, welded, clipped or the like at specified locations along the tube. Preferably, connectors 116 are also provided at a distal end 118 of each tube 82 and, as with base connector 88A, may function as the base connector.

With the spring 71 in a pre-stressed state, initial tuning of the guitar 30 is relatively quick and easy. To string the guitar 30 illustrated in FIGS. 2-4, the first end 52 of each string 50A-F is appropriately attached to its corresponding tuning knob 58A-F and the second end 54 is attached to a corresponding string holder 100. The tuning knob 48 is then turned to take up the slack in the string 50 so that the spring 71 is engaged. Further turning of the tuning knob 48 with the spring 71 engaged increases tension applied to the string 50 by the spring 71. Preferably, the spring 71 is chosen to have a rate (increase in lbs. of tension applied per inch of elongation) adapted so that it will take only one to a few turns of the tuning knob 48 to achieve a musical string tension corresponding to proper string tune.

In a preferred embodiment, a spring 71 having a rate of about 20 lb./in is employed. However, it is to be understood that a wide range of spring rates can be employed. For example, a spring 71 having a rate of about 40 lb./in could be used, and would enable use of shorter spring tubes 82. Conversely, a spring having a rate of 1-5 lb./in could also be used. With such a spring, elongation of the corresponding musical string, which happens naturally, will have little effect on tune of the string, and thus the instrument will stay in or close to tune despite string elongation.

In the illustrated embodiment, the spring connector bodies 95 and the attached stops 110 are matingly threaded so that each stop 110 is movable over its corresponding elongate spring connector 90. Further, a tune indicator line 120 preferably is provided circumferentially around a portion of each stop 110; a tune indicator reference line 122 is also provided on each tube 82. A view hole 124 preferably is formed through each tube 82 so that a portion of the stop 110 within the tube 82 is visible through the view hole 124. Preferably, the reference line 122 on the tube is provided adjacent the view hole 124.

Figure 3A:
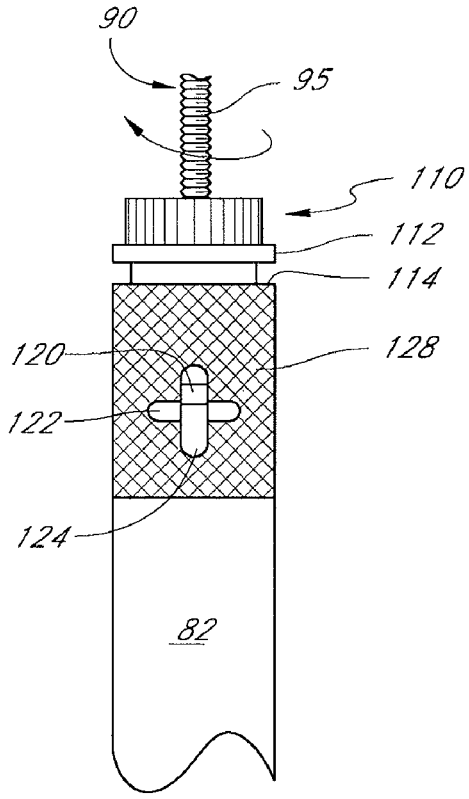
FIG. 3A is a close up view of a stop member in a position relative to a corresponding tube and spring connector when a corresponding string has just been placed in correct tune.
Figure 3B:
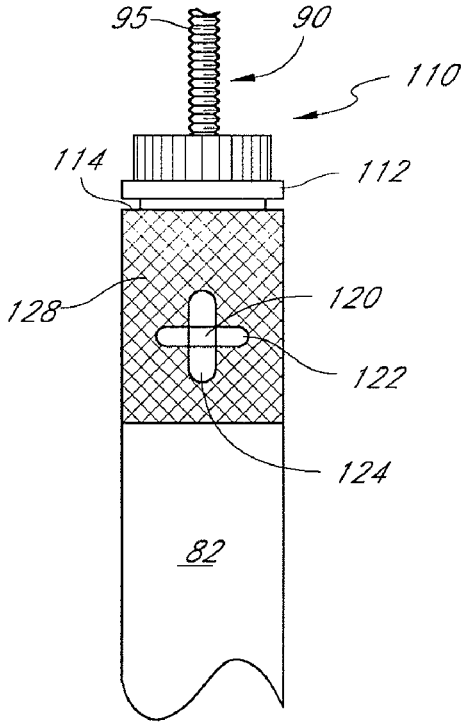
FIG. 3B shows the arrangement of FIG. 3A after the stop member has been moved to align the stop tune indicator with the tube reference indicator.

With specific reference to FIGS. 3A and 3B, to achieve a visually-indicated tune of the illustrated guitar, the strings 50 are first installed and preferably tuned by a conventional method. The stops 110 are not involved in the initial tuning procedure, and the stop reference line 120 and tube reference line 122 likely will not be aligned, as depicted on FIG. 3A. Once the strings 50 are tuned, each stop 110 is moved along its corresponding spring connector 90 so that the stop tune indicator 120 is aligned with the reference indicator 122 on the corresponding tube 82 as depicted in FIG. 3B. Such alignment establishes a mechanical and visual indicator of a perfectly-in-tune condition. The position of the stop 110 on the spring connector 90 does not affect tension applied to the string 50, so moving the stop 110 establishes a reference point without affecting string tension.

Musical strings tend to stretch during play due to environmental changes or other factors. In the past, a musician would have to periodically stop play to check or retune his instrument. Such tuning required plucking or otherwise sounding the string 50, and then using a tuner, ear, or other method to verify and/or adjust the tune. Certain electronics-based products including sensors may also be used to determine tune. Also, electromechanical devices employing motor-driven tuning knobs controlled by electronic controllers based on sensor input can also be employed.

In the illustrated embodiment, change in the elongation of the strings 50 will be mechanically indicated by the stop and tube reference indicators 120, 122 going out of alignment. This can be visually checked by the user, and even visually corrected by adjusting the tuning knob 48 until the indicators 120, 122 are again aligned. With the indicators 120, 122 returned to alignment, the instrument is again in perfect tune since the spring 71 is again stretched to the displacement (and corresponding tension) corresponding to perfect tune, which measurement was established when the instrument was initially tuned. As such, tune can be checked and corrected without ever sounding the string 50. Also, elongation of a string 50 can be identified and corrections made even before there is an audible effect on the string's tune.

With continued reference to FIGS. 3, 3A and 3B, the illustrated embodiment shows alternatives for indicator line configurations. For example, in tubes 82A, B and C, reference indicators 122 are printed directly on the tubes. In tubes 82 D, E, and F, a dark coating 128 is deposited on the tubes around the view hole 124, and the reference indicator lines 122 are printed on the dark coating 128 so as to provide increased contrast.

Other embodiments can use various structures and methods to increase visibility of the indicator lines 120, 122. For example, in one embodiment, the indicator lines are made using a phosphor or other material that will enable the lines to glow and/or more readily reflect light. As such, the alignment of the indicator lines 120, 122 can be easily observed even by a musician performing in a darkened venue. In still another embodiment a light source, such as an LED or laser, is provided on the mounting system, such as in or around the frame 72, in or on the spring tubes 82, or elsewhere, so as to directly or indirectly illuminate the indicator lines 120, 122 and/or provide a back light to aid viewing of the indicator lines. Still further lighting structures and methods, such as fiber optics and the like, can also be employed.

For example, the indicator 122 may include an aperture, and the indicator 120 may comprise a precisely-focused light, such as from a laser or fiber optic. When the indicators 120, 122 are appropriately aligned, the light is visible through the aperture. In another embodiment, the aperture includes a light-diffusing material that will glow when light impinges thereon. In still another embodiment, indicator 120 includes the aperture and indicator 122 includes the light.

In yet another embodiment, rather than providing a view aperture 124 in the spring tubes 82, the reference tune is determined by aligning the stop reference line 120 with the end 114 of the spring tube 82. In still other embodiments, a reference for aligning with the stop 120 can be provided on the body of the guitar, on the frame, or in any other suitable location.

In still another embodiment, a first photodetector is disposed immediately adjacent a first side of the reference line 122 and a second photodetector is disposed immediately adjacent a second side of the reference line 122. A laser or other precisely-focused light source is provided at the stop reference line 120. The photodetectors are adapted so that they do not see the light source when the stop is properly aligned. However, if the string elongates or contracts sufficient to move the stop 100, the light source will be detected by one of the photodetectors.

Preferably, each photodetector is adapted to generate a signal to indicate that the particular string 50 is varying from perfect tune. For example, if the first photodetector detects the light source, a yellow signal lamp is lit, signaling the musician to tighten the string, but if the second photodetector detects the light source, a red signal lamp is lit, signaling the musician to loosen the string. The signal is extinguished when perfect tune is again achieved. Thus, visual tuning can be achieved using media other than the musician's eyes to detect changes in string tension and tune.

In yet another embodiment, the photodetector signals may trigger automatic tuning correction without direct intervention by the musician. U.S. Pat. No. 6,437,226, the entirety of which is incorporated herein by reference, discloses a system in which a transducer detects a string vibration, which is then analyzed to determine if it is in proper tune. If the string is out of tune, motors are actuated to tighten or loosen the string to restore it to proper tune. In the present embodiment, such motors may be actuated by the photodetector signals without the need of detecting and analyzing string vibrations. Strings may be automatically kept in tune without requiring sounding of the string.

In the embodiment illustrated in FIGS. 2-4, the string mounting system 70 is attached to the guitar body 33 by a frame 72 that attaches to the outside of the body 32. In another embodiment, the string mounting system 70 may employ a frame incorporated within and supported by the body 32 of the guitar 30. Components such as the spring tubes 82 may be at least partially hidden from view. In a still further embodiment, rather than a plurality of spring tubes, a spring box is provided, each box containing multiple springs. In yet further embodiments, rather than using boxes or tubes, the first end 84 of each spring 71 may even be attached to a frame portion that may be incorporated into the body of the guitar.

In still further embodiments, the springs can be at least partially embedded in the body of the guitar and may act in a direction transverse and/or opposite to the direction of the string. In such embodiments, the spring may be connected to the string by a pulley, lever, cam, or other mechanical interface to provide a mechanical advantage, disadvantage, and/or redirect the spring tension.

Figure 5:
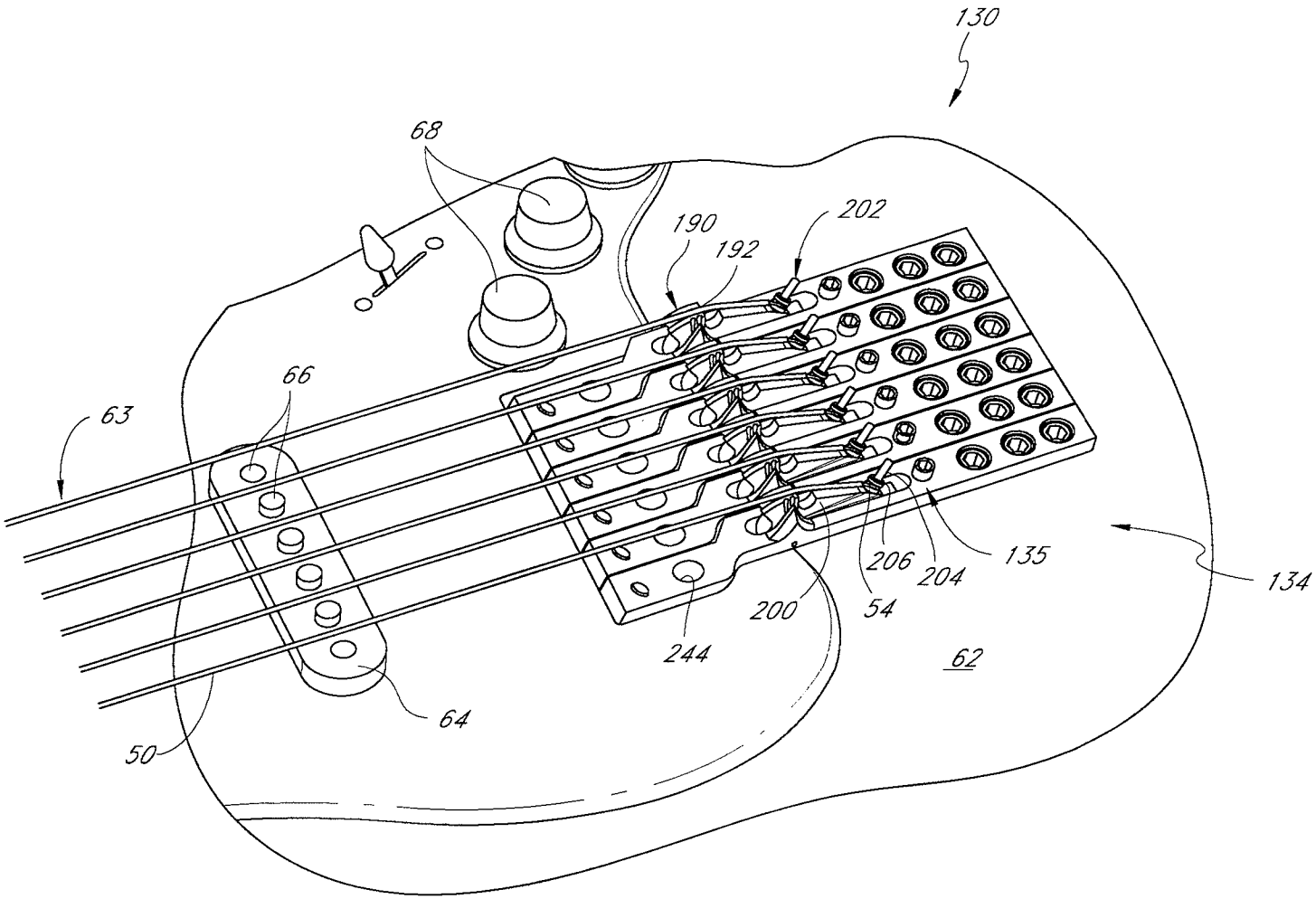
FIG. 5 is a close up perspective view of another embodiment of a guitar with a string mounting system having aspects in accordance with the present invention.

With reference next to FIG. 5, another embodiment of a guitar 130 employing a string mounting system 134 is illustrated. In the illustrated embodiment, the string mounting system 134 uses a set of six string tensioners 135 attached to the face 62 of the guitar body 32 and arranged side by side. One tensioner 135 corresponds to each musical string 50. As will be discussed in more detail below, each tensioner 135 uses a spring 138 to supply tension to the corresponding string 50. However, a spring force modulating member 140, such as a cam, is interposed between the string 50 and the spring 138 so that the actual tension applied to the string 50 by the spring 138 is not necessarily the same as the tension of the spring 138. Most preferably, the modulating member 140 is adapted so that the change in the tension supplied to the string by the spring upon a corresponding change in spring length is not linear. More specifically, the change in force actually applied by the spring 138 to the string 50 as the spring 138 changes length is modulated and preferably tempered by the mechanical member 140 interposed between the spring 138 and the string 50. In the illustrated embodiment, the modulating member 140 functions as a mechanical interface between the string 50 and the spring 138.

With reference next to FIGS. 6-9, several views are provided of a preferred embodiment of a string tensioner 135. The illustrated string tensioner 135 comprises an elongate body 142 having a top surface 144 and having a bottom surface 146 that is adapted to be attached to the front face 62 of the guitar 130. The tensioner body 142 has a first end 148 and a second end 150. Preferably, the elongate body 142 is positioned on the guitar body 62 so as to be generally aligned with a corresponding guitar string 50. The first end 148 is generally closer to the neck 34 than the second end 150, which is closer to a rear of the guitar 130.

Figure 7:
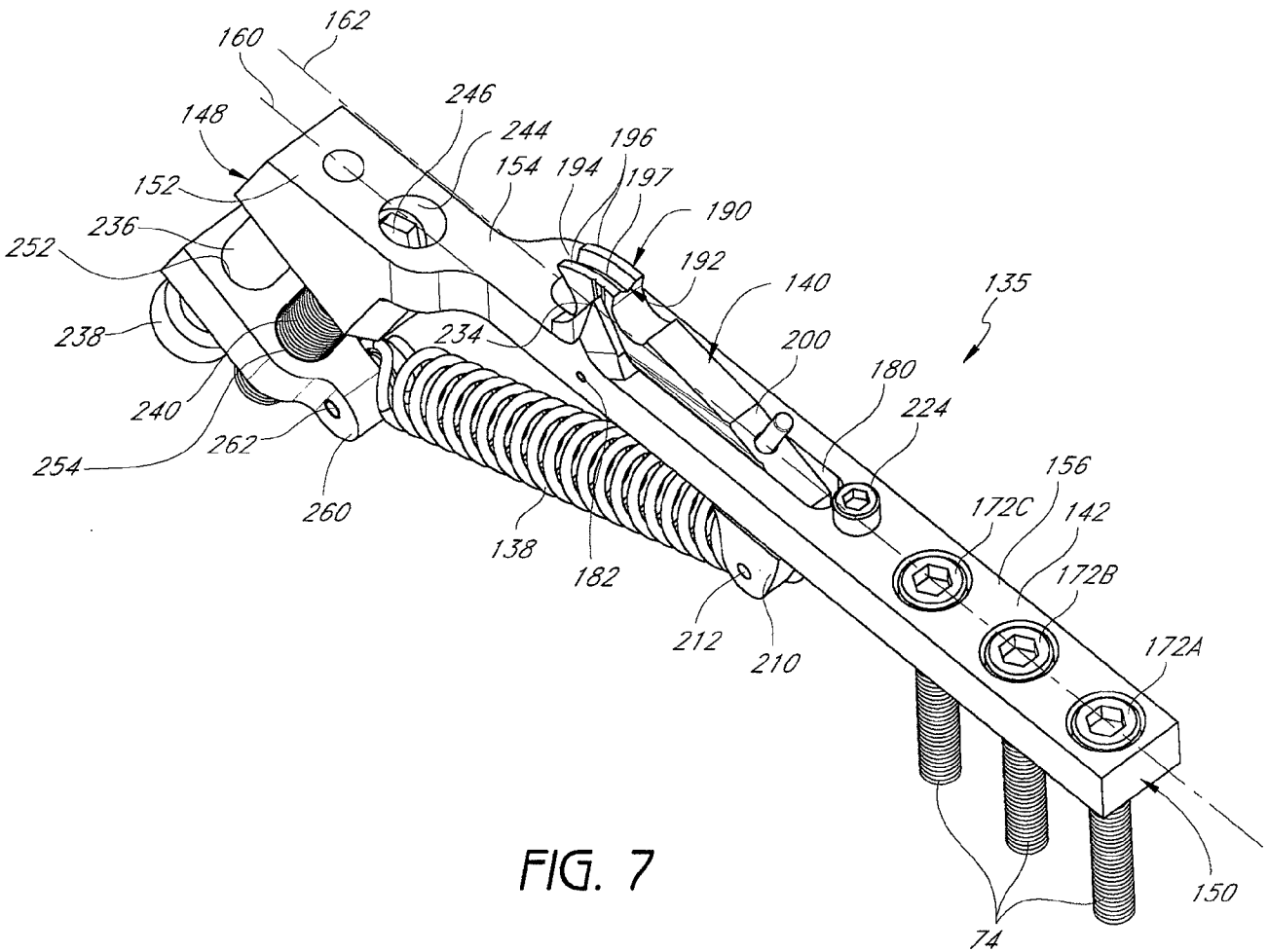
FIG. 7 is a perspective view of the string tensioner of FIG. 6.

A first portion 152 of the tensioner body 142 is defined generally adjacent the first end 148. An offset section 154 is interposed between the first portion 152 and a second portion 156 of the tensioner body 142, which is defined on a side of the offset section 154 opposite the first portion 152. As such, a longitudinal center line 160 of the first portion 152 preferably is generally parallel to but spaced from a longitudinal center line 162 of the second portion 156, as best shown in FIG. 7.

A depending portion 164 extends downwardly and, preferably, forwardly from the first portion 152. Preferably a cavity 166 is formed in the guitar body 32 (see FIG. 12) to accommodate the depending portion 164 and other parts of the string tensioner 135 that are disposed below the bottom surface 146 of the tensioner body 142.

A plurality of mounts 170 preferably are provided for engaging the guitar body 32 and holding the string tensioner 135 in place. In the illustrated embodiment, three apertures 172A-C are formed in the second portion 156 of the tensioner body 142. Each aperture 172A-C is configured to accommodate an elongate fastener 174 adapted to extend into the guitar body 32. In one embodiment, the fasteners 174 comprise screws. In another embodiment, the fasteners 174 comprise bolts. In still another embodiment, bolt receivers (not shown) are embedded into the guitar body 32 and the fasteners comprise bolts adapted to engage the bolt receivers so as to hold the string tensioner body 142 firmly in place on the guitar body 32.

With continued reference to FIGS. 6-9, an elongate aperture 180 is formed through the second portion 156 of the tensioner body 142. A spring force modulation member 140 is adapted to fit generally within and through the elongate aperture 180. The modulation member 140 is connected to the body 142 by a pivot 182. In the illustrated embodiment, the pivot 182 comprises an axle extending transversely across the elongate aperture 180. The modulation member 140 rotates about the pivot 182. In the illustrated embodiment, the pivot 182 comprises an axle. It is to be understood that other structures may be employed. For example, in another embodiment, a wedge-shaped member having a relatively narrow upper edge, also sometimes referred to as a "knife pivot", is adapted to support the modulation member 140. The modulation member 140 may thus rock about the upper edge, enabling pivoting with very little friction.

Figure 6:
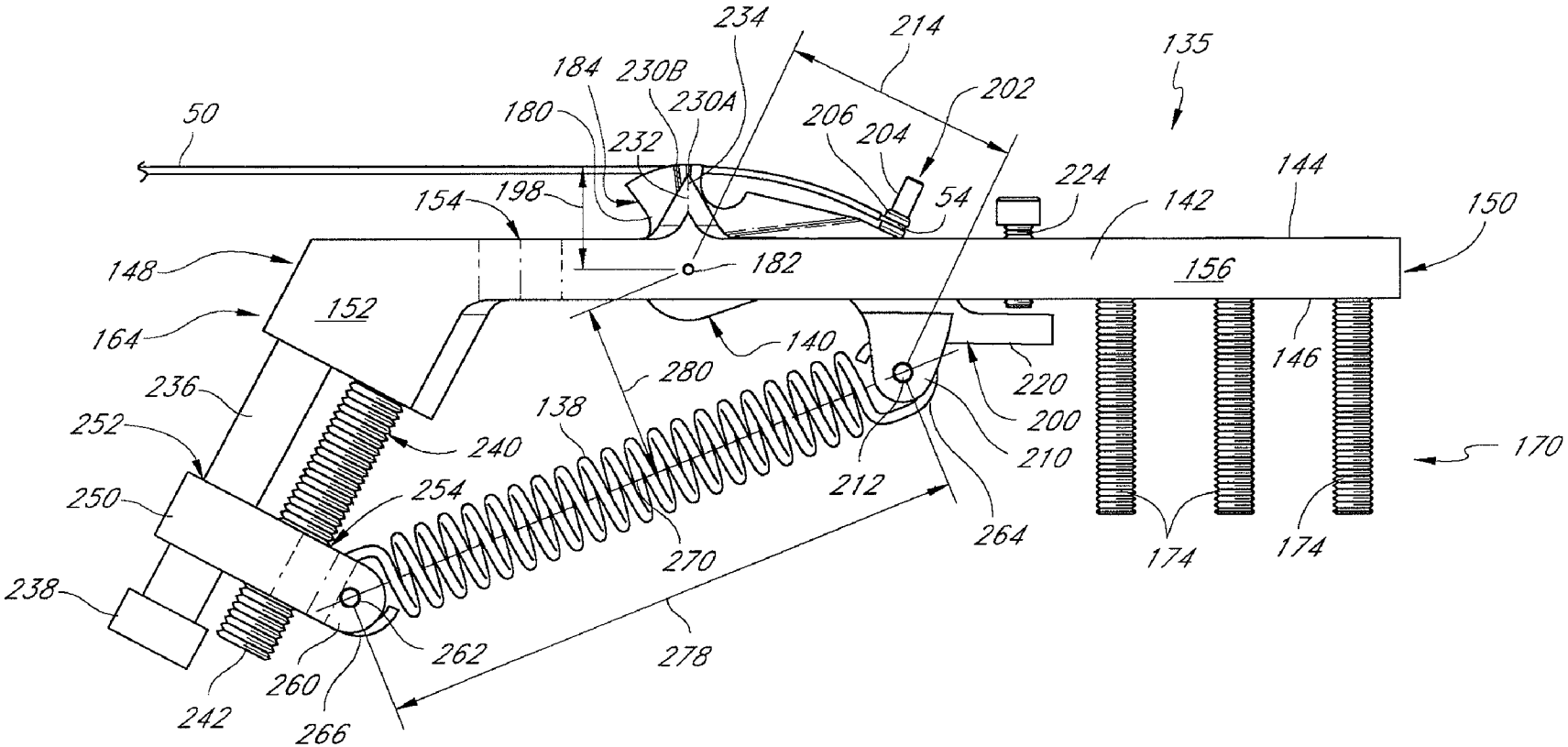
FIG. 6 is a schematic side view of a string tensioner used in accordance with the embodiment illustrated in FIG. 5.

A cam portion 184 of the modulation member 140 extends generally upwardly from the pivot 182 and comprises a string receiver 190. As illustrated, the string receiver 190 preferably comprises a saddle 192 or string track 192 adapted to accommodate and hold the guitar string 50 therein as shown in FIGS. 5 and 6. The saddle 192 preferably is defined by an elongate cavity 194 between a pair of projecting portions 196. (See FIG. 7.) A base or floor 197 of the saddle 192 preferably is arcuate, preferably generally matching the arc of a radius 198 measured from the pivot 182 to the base 197 of the saddle 192. Preferably, the distance 198 from the pivot 182 to the base 197 of the saddle 192 is generally constant along the length of the saddle 192. However, in other embodiments, the radius may vary along the length of the saddle 192.

An arm 200 of the force modulating member 140 extends generally rearwardly and through the body 142 to a point below the tensioner body bottom surface 146. A string connector 202 preferably extends upwardly from the arm 200 and is spaced from the string receiver 190. In the illustrated embodiment, the string connector 202 comprises a generally cylindrical rod 204 adapted to engage a corresponding connector 206 disposed on the end 54 of the musical string 50. Preferably, the connector 206 on the string 50 comprises an eyelet that slips over the rod 204. It is anticipated that other string connecting structures may be used in other embodiments.

A spring mount 210 is provided on the modulating member arm 200 generally below the bottom surface 146 of the body 142. Preferably, the spring mount 210 comprises a pin 212 adapted to accommodate an end of a tension spring 138. The pin 212 can be a rod, axle, bolt, screw, or other suitable structure. In the illustrated embodiment, spring tension is communicated to the arm 200 via the pin 212. Further, a distance 214 between the modulating member pivot 180 and the spring mount pin 212 is fixed, and helps define the proportion of spring tension communicated through the arm 200 to the associated string 50.

A stop engagement portion 220 of the arm 200 extends rearwardly relative to the spring mount 210 and, preferably, below the bottom surface 146 of the tensioner body 142. A stop aperture is formed through the tensioner body 142. Preferably, a stop bolt 224 is threadingly advanced through the aperture. The stop bolt 224 is configured to engage the stop engagement portion 220 of the arm 200 to define a limit to rotation of the arm 200 in a counter-clockwise direction.

Continuing with reference to FIGS. 6-9, preferably, a plurality of marks 230A-B are provided on the force modulation member 140 for reference purposes. Additionally, preferably an indicator member 232 extends upwardly from the tensioner body 142 and is generally aligned with the pivot 180. The indicator member 232 preferably includes a tip 234. In use, the rotational position of the modulating member 140 relative to the tensioner body 142 can be gauged by the position of the reference marks 230A-B relative to the indicator member tip 234.

Preferably, an elongate guide member 236 depends from the first portion 152 adjacent to the first end 148 of the body 142. Preferably, the guide 236 terminates in a stop 238 attached thereto. In the illustrated embodiment, an elongate adjustment bolt 240 also depends from the depending portion 164 of the body 142 in a direction generally parallel to the elongate guide 236. In the illustrated embodiment, the guide 236 and bolt 240 extend in a direction generally downwardly and forwardly from the tensioner body 142. Preferably, the adjustment bolt 240 is threaded. An elongate shank 242 of the adjustment bolt 240 fits through an aperture 244 defined through the tensioner body 142, and a bolt head 246 is accessible through the top surface 144 of the body 142 so that the adjustment bolt 240 can be rotated through the use of a tool or the like. Since the adjustment bolt head 246 is disposed in the first portion 152, which is offset relative the second portion 156, the bolt head 246 is not aligned with the musical string 50 corresponding to the tensioner 135 (see, for example, FIG. 17). As such, a tool can access the bolt head 246 without interfering with the string 50.

Figure 8:
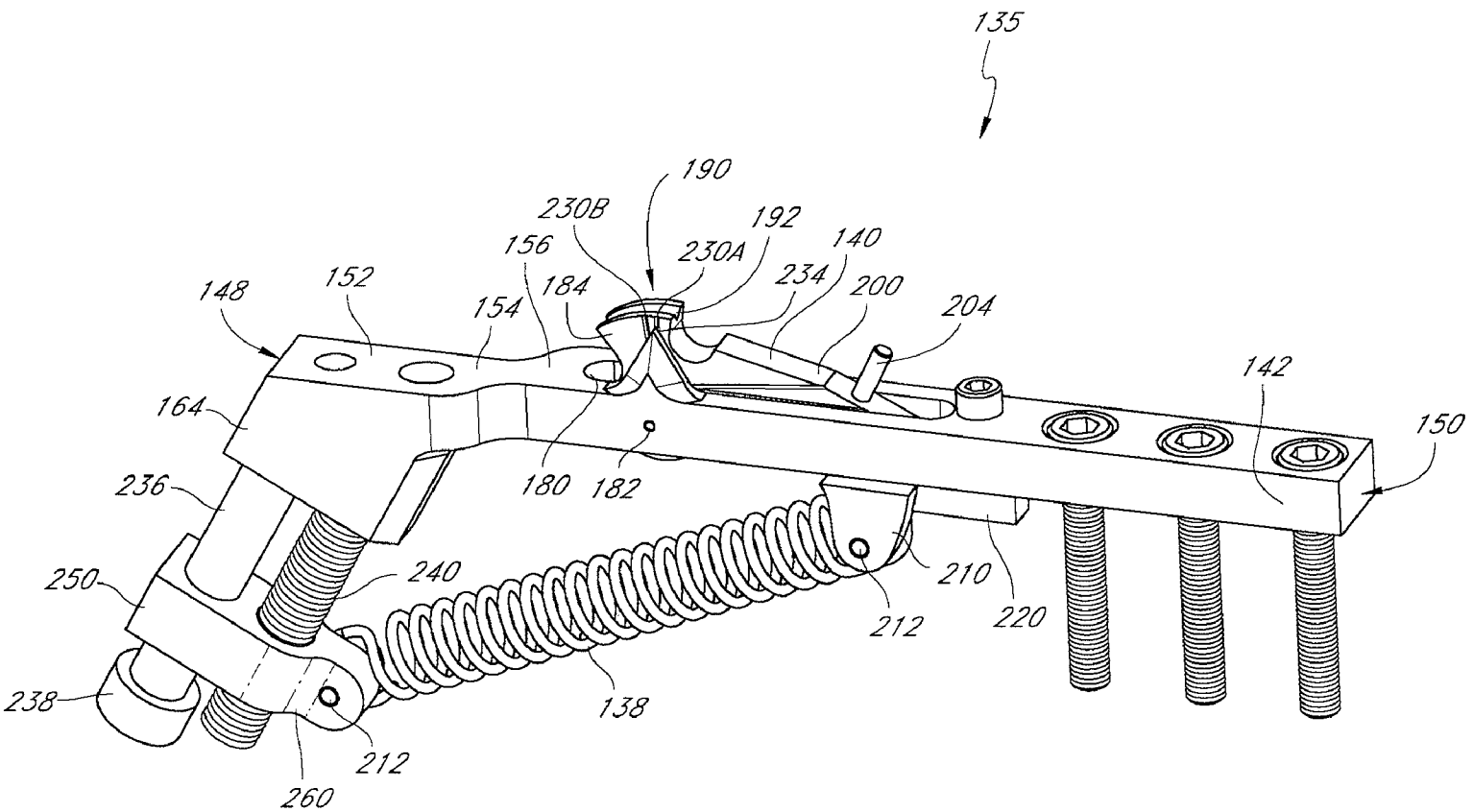
FIG. 8 is another perspective view of the string tensioner of FIG. 6.
Figure 9:
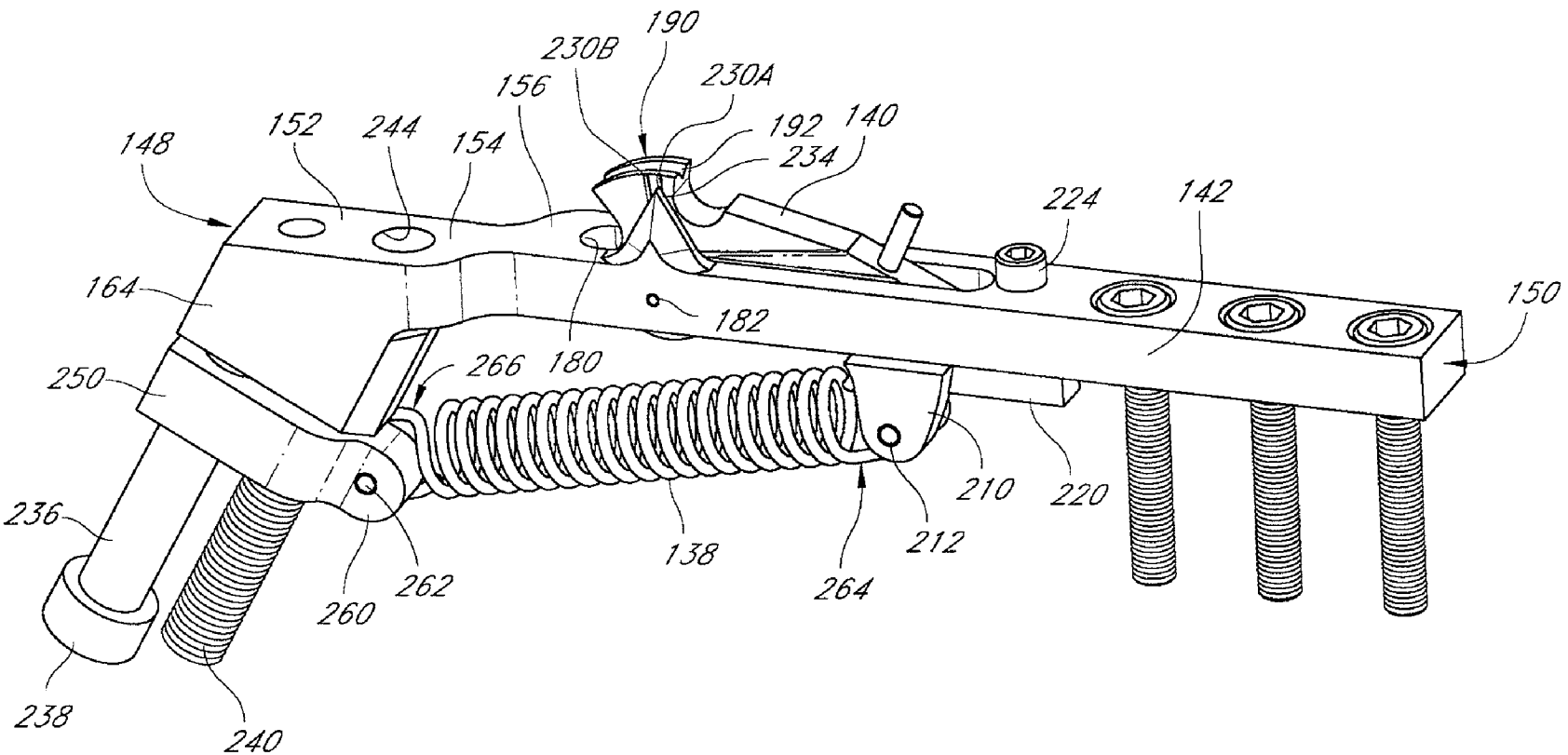
FIG. 9 is a perspective view of the string tensioner of FIG. 6 but showing a shuttle 250 of the string tensioner disposed in a different position.

A shuttle 250 is provided over the elongate guide 236 and adjustment bolt 240. The shuttle 250 preferably comprises a first aperture 252 adapted to fit slidably over the elongate guide 236 and a second, threaded aperture 254 adapted to mate with the threads of the adjustment bolt 240. As such, when the adjustment bolt head 246 is rotated, the shuttle 250 is advanced or retracted along the bolt 240 and guide 236. For instance, FIGS. 6-8 show the shuttle 250 in a first position along the adjustment bolt 240, and FIG. 9 shows the shuttle 250 in a second position along the adjustment bolt 240. Rotation of the bolt effectuates such changes in shuttle position.

With continued reference to FIGS. 6-9, the shuttle 250 preferably additionally comprises a spring mount 260 having pin 262 such as an axle, rod, bolt, screw, or other structure adapted to engage an end of the tension spring 138. The tension spring 138 preferably has first and second opposing ends 264, 266. The first end 264 of the spring 138 is attached to the spring mount 210 on the modulation member arm 200; the second end 266 of the spring 138 is attached to the spring mount 260 of the shuttle 250. As such, a longitudinal axis 270 of the tension spring 138 extends between the pins 212, 262 of the modulating member spring mount 210 and the shuttle spring mount 260. Spring force is directed along this axis 270.

Figure 10:
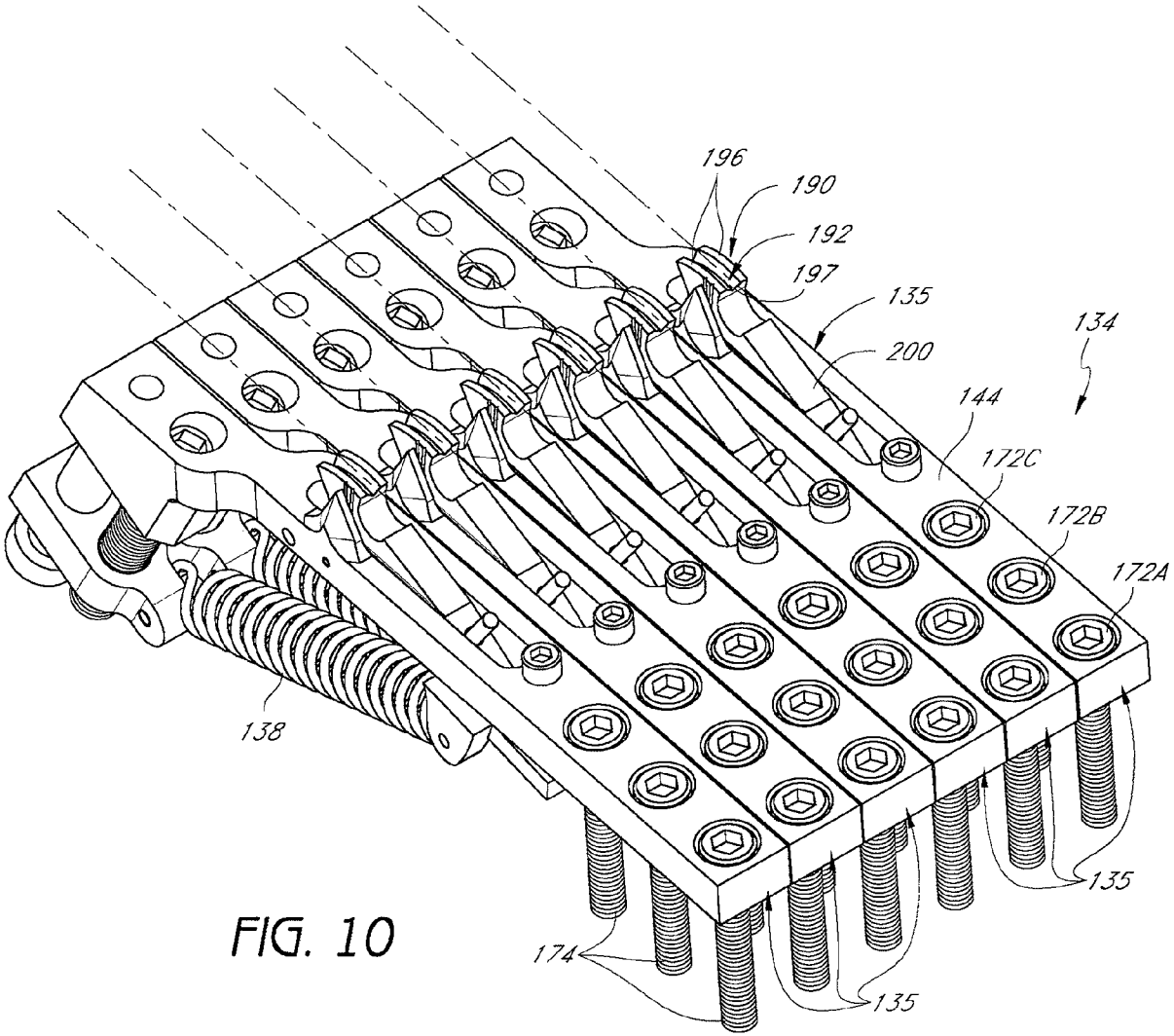
FIG. 10 is a perspective view showing a plurality of string tensioners arranged into the string mounting system of a guitar.
Figure 11:
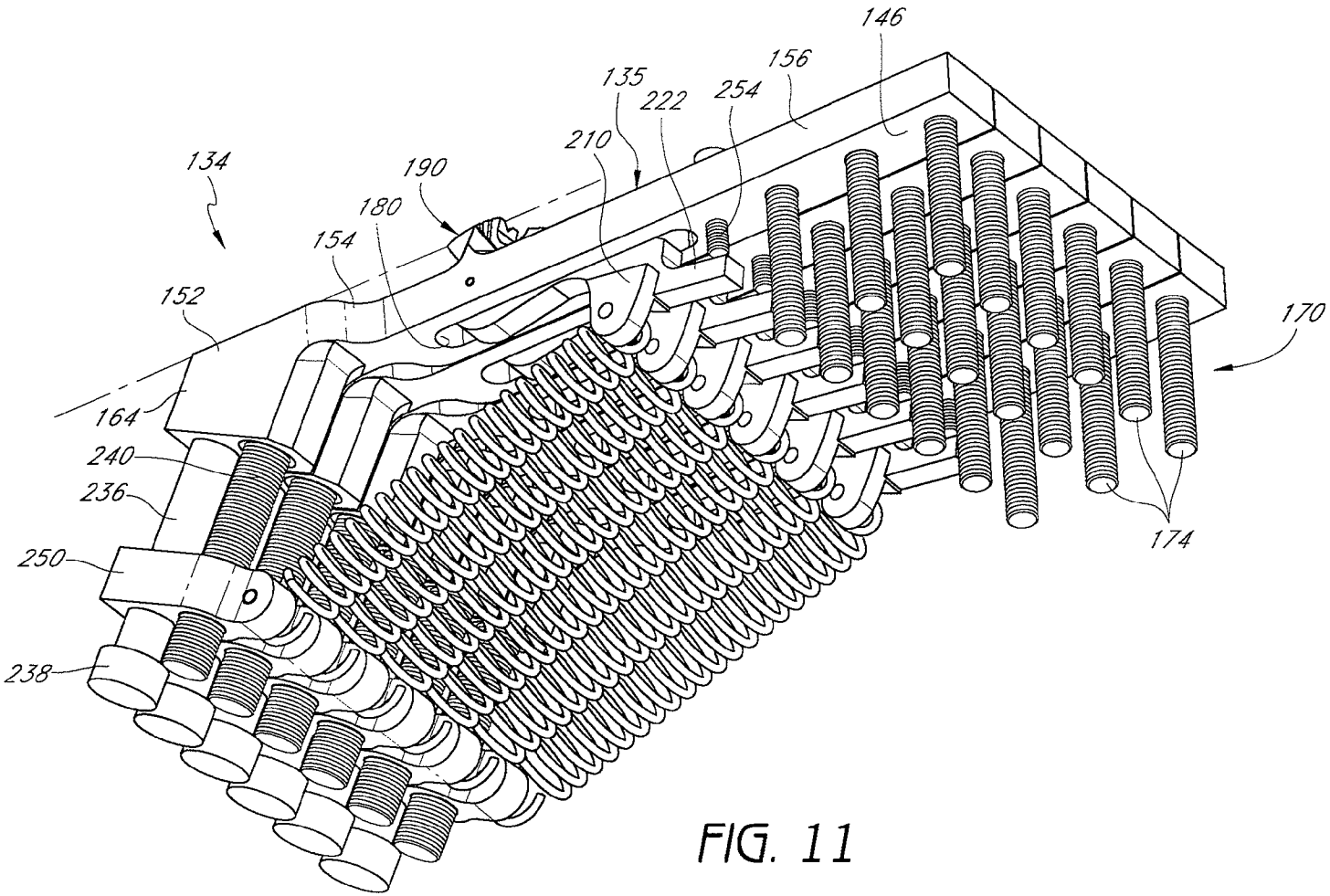
FIG. 11 is a rear perspective view of the string tensioners of FIG. 10.
Figure 12:
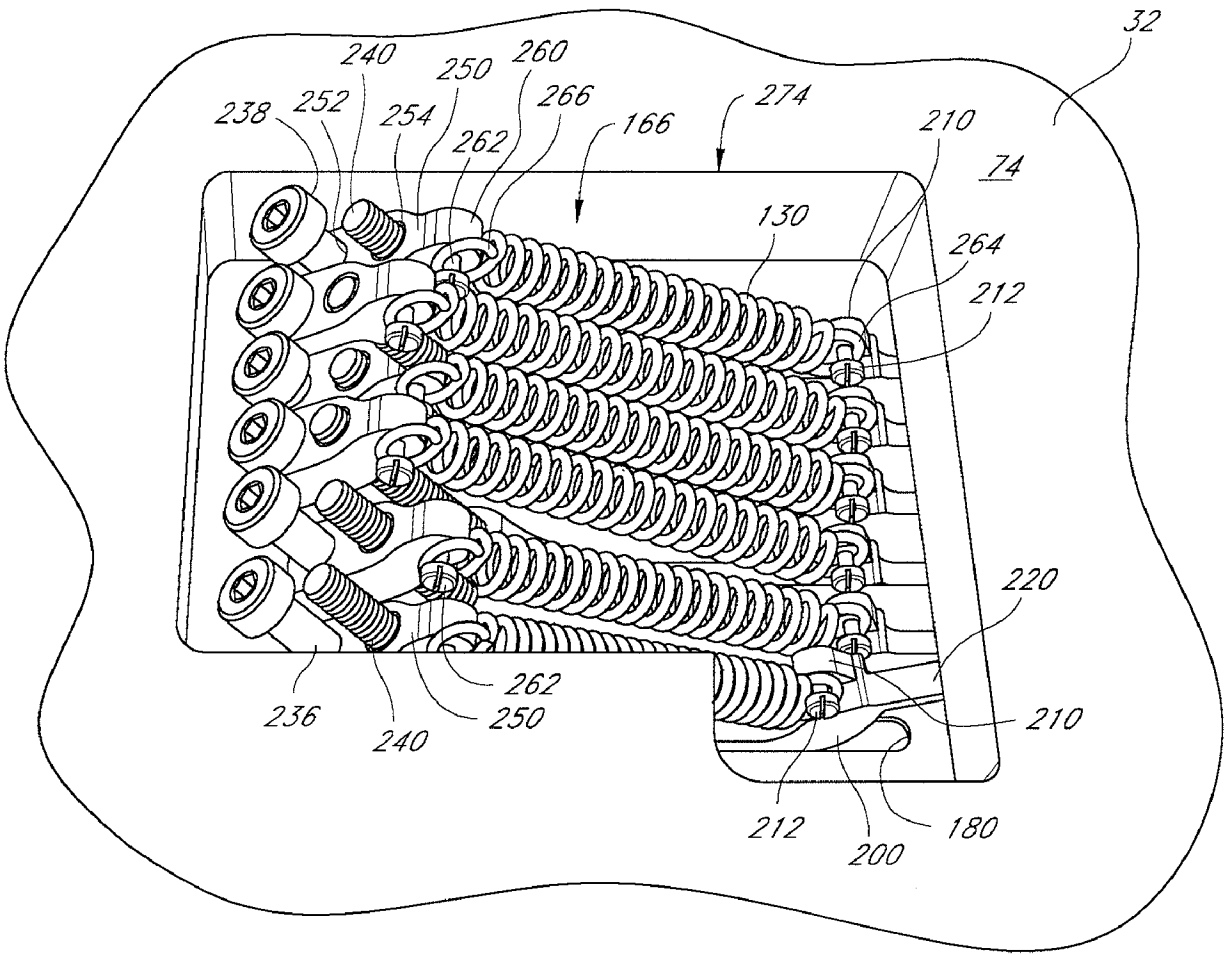
FIG. 12 is a perspective view of a back side of the guitar of FIG. 5 showing a portion of the string tensioner system disposed in a cavity formed in the guitar body.

With reference next to FIGS. 5-12, in a multi-string instrument, such as a guitar 130, preferably a plurality of string tensioners 135 are arranged side-by-side generally abutting one another, as depicted in FIGS. 5 and 10. In the illustrated embodiment, six string tensioners 135 are provided side-by-side to appropriately secure and provide tension to the six musical strings 50 of the guitar 130. As best shown in FIGS. 5 and 12, preferably the string tensioners 135 are attached to a front face 62 of the guitar body 32. Components of the tensioners 135 that depend below the bottom surface 146 of each tensioner body 142 extend into the cavity 166 formed in the body 32 of the guitar 130. The guitar body cavity 166 can extend through the entire guitar body 32, and thus provide an access 274 through the back, as suggested by FIG. 12. In another embodiment, an access door may be provided to selectively close the cavity 166 through the back 74 of the guitar body 32. In still another embodiment, the guitar body cavity does not extend clear through the guitar body.

Figure 13:
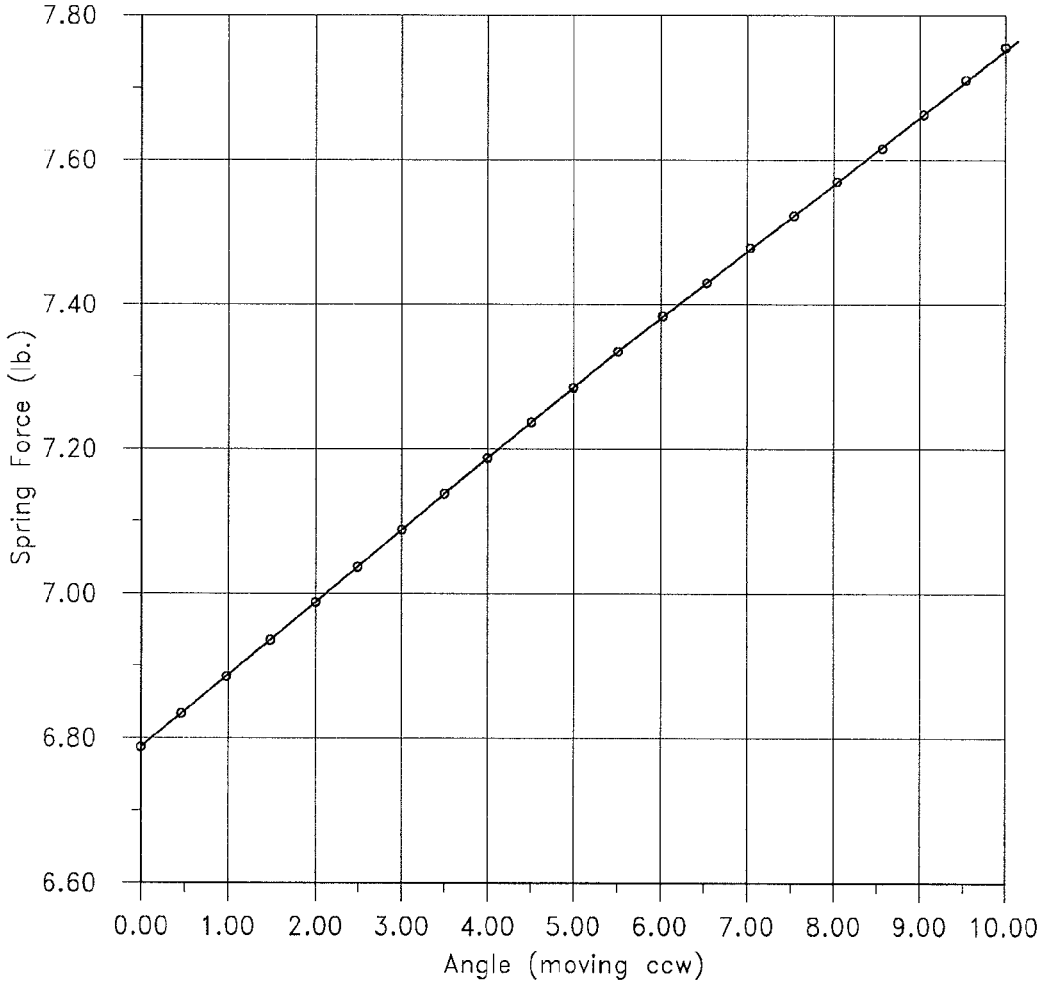
FIG. 13 is a graph depicting the change in spring force as the arm of the spring tensioner of FIG. 6 moves counter clockwise.

With specific reference next to FIG. 6, certain functions and properties of the individual string tensioners 135 are presented. As illustrated in FIG. 6, each spring 138 extends between spring mounts 210, 260 defined on the force modulating arm 200 and the shuttle 250, respectively. As is typical with coil springs, a length 278 of the spring 138 determines the degree to which the spring has elongated, which in turn determines the magnitude of force exerted by the spring. As shown, since the adjustment bolt 240 is angled relative to the spring's line of action, or longitudinal axis 270, movement of the shuttle 250 has the effect of increasing or decreasing the length 278 of the spring 138 for a given position of the modulating member arm 200. However, when the shuttle 250 is held fixed in a position, and thus the shuttle spring mount 260 is fixed, rotation of the force modulating member 140 about the pivot 182 correspondingly results in linear movement of the modulating arm spring mount 200, which linear movement increases or decreases the length 278 of the spring 138. Specifically, when the modulating member 140 is rotated counter-clockwise, the length 278 of the spring 138 increases, thus resulting in an increase of the force exerted by the spring. With additional reference to FIG. 13, a plot is presented of a sample embodiment having structure similar to the illustrated tensioners 135. In the illustrated embodiment, as the modulating member 140 is rotated counter-clockwise, the force exerted by the spring in response to spring elongation increases generally linearly over the illustrated limited range of rotation (here 10°).

With continued reference to FIG. 6, the spring 138 has a line of action generally along its longitudinal axis 270. The longitudinal axis 270 is spaced a lever arm distance 280 from the pivot point 182. The lever arm distance 280 determines the mechanical advantage (or, in some embodiments, mechanical disadvantage) the spring 138 has relative to its load, the string 50, which has a radius 198 spacing from the pivot point 182. When the shuttle 250 is held in a fixed position, rotation of the force modulating arm 200 results in a change in the lever arm distance 280.

Figure 6A:
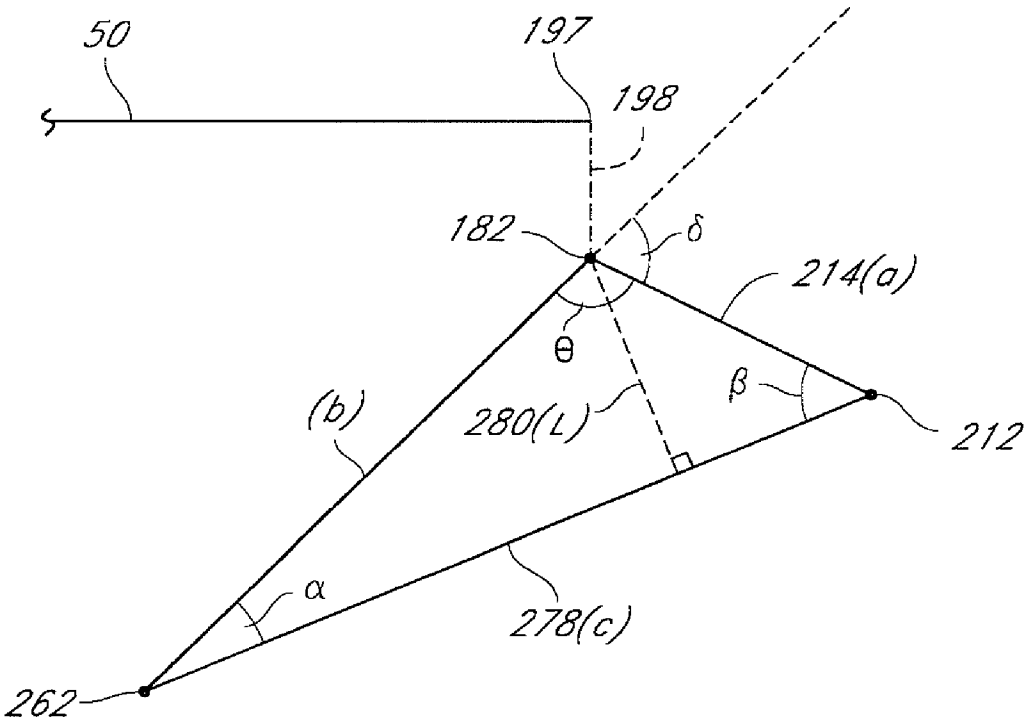
FIG. 6A is a diagram schematically representing certain relationships of the embodiment illustrated in FIG. 6.

With additional reference to FIG. 6A, a schematic diagram represents certain relationships of the embodiment illustrated in FIG. 6. For example, the pivot point 182, string saddle base 197, pin 212, and pin 262 are represented, as well as lines 198, 214, 278 and (b) representing the distances between these points.

Figure 14:
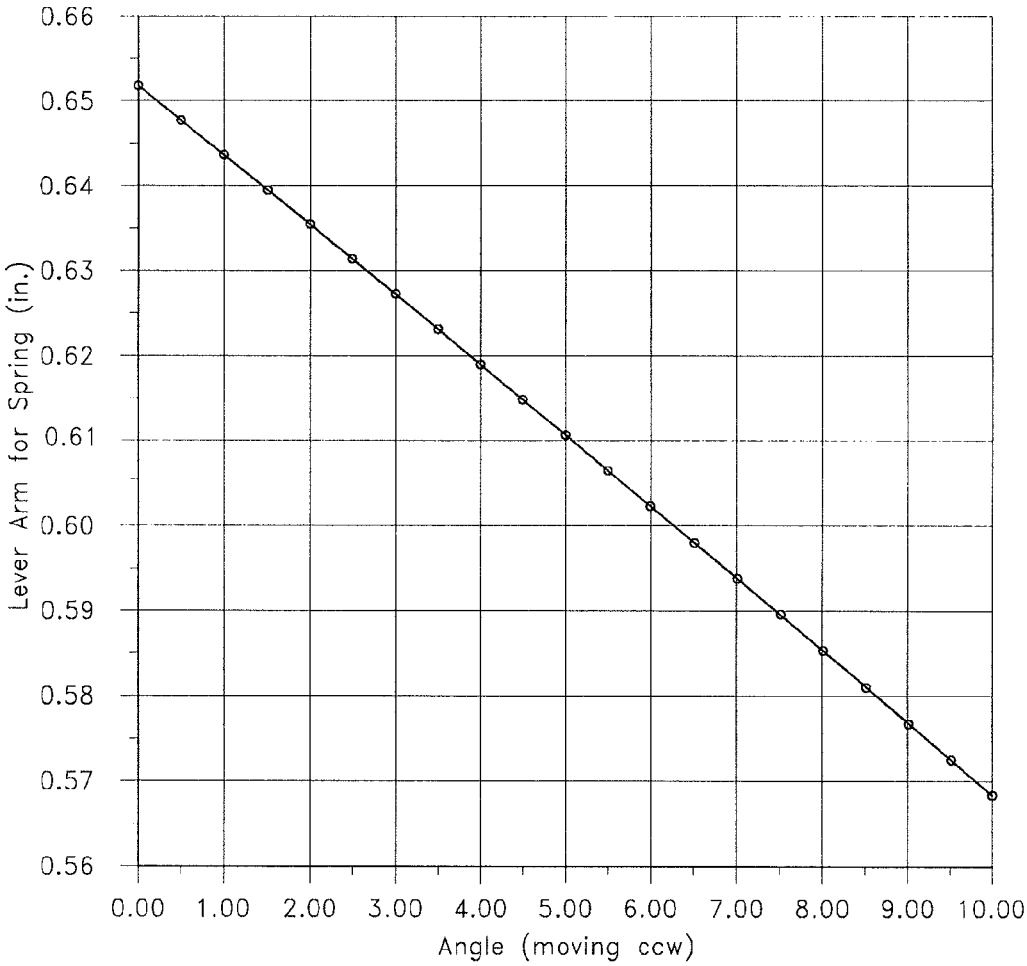
FIG. 14 is a graph depicting the change in effective lever arm of the spring as the arm of the spring tensioner of FIG. 6 moves counter clockwise.

With additional reference to FIG. 14, a plot is presented showing the change in lever arm distance 280 for the spring 138 as the modulating member 140 is rotated counter-clockwise through a limited range of modulating member rotation (here 10°). As shown, the lever arm 280 distance decreases generally linearly as the modulating member 140 is rotated counter-clockwise.

As just discussed, as the force modulating member 140 is rotated counter-clockwise, such as when the string 50 is being tightened on the guitar, the spring 138 elongates, and spring tension thus linearly increases. However, at the same time, the lever arm distance 280 upon which the spring 138 is acting linearly decreases. These effects act in opposition to one another, thus creating a special advantageous effect on string tension during such angle changes. For example, with additional reference to FIG. 15, a plot of string tension actually delivered to the string 50 from the spring 138 via the force modulating member 140 is illustrated. This plot shows the combined effect of the changing spring force and lever arm distance as the modulating member rotates.

Figure 15:
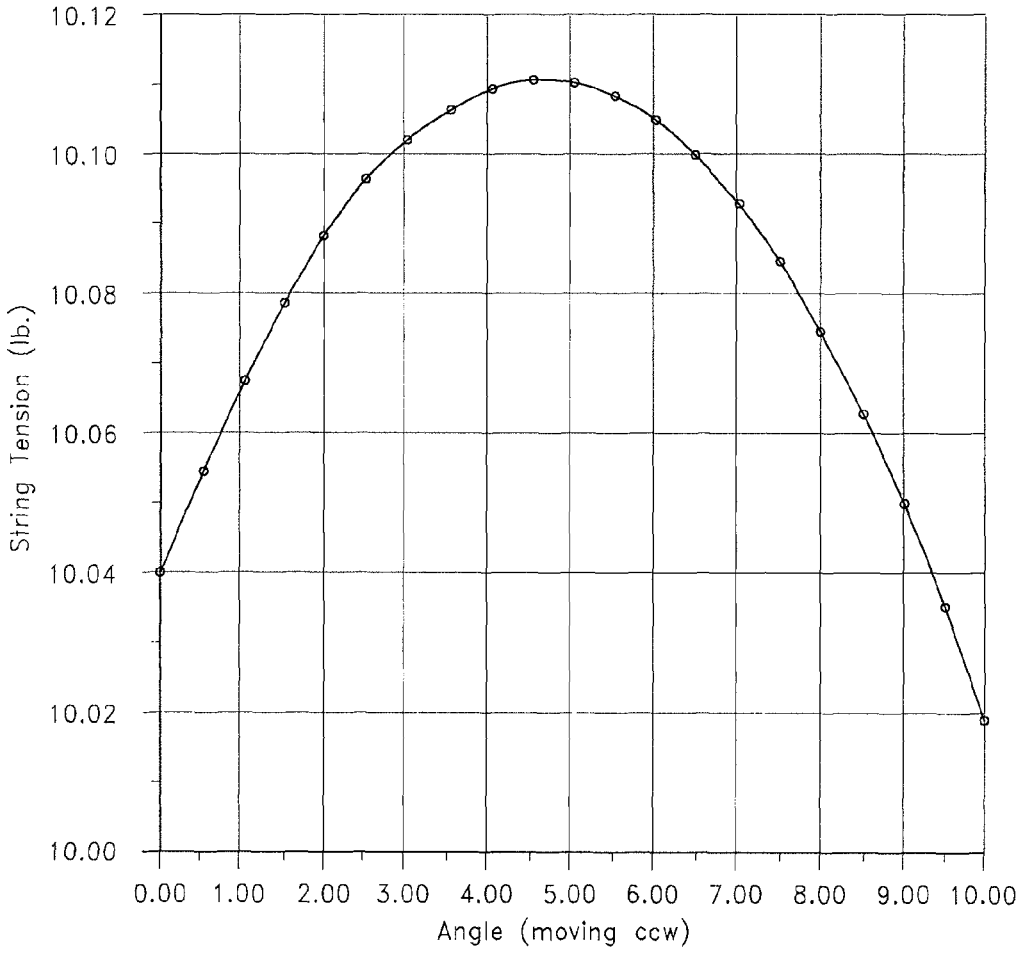
FIG. 15 is a graph depicting the change in effective string tension resulting from the effects shown in FIGS. 13 and 14 as the arm of the spring tensioner moves counter clockwise.

It should be appreciated that the scale of FIG. 15 is highly amplified, exaggerating the curvature. In fact, this is a relatively flat curve over the small anticipated angle of operation of the modulating member 140. For instance, for a preferred embodiment, the modulating member 140 operates in a range between about two degrees to seven degrees of angle. In the illustrated embodiment, over this five-degree range of rotation, the string tension changes within a range of only about 0.02 pounds. It should be appreciated that 0.02 pounds of tension corresponds roughly to one cent of pitch, which corresponds to such a small change in the pitch of the tone emitted by the corresponding string that the change of pitch is not detectable by the human ear. As such, even if during play or other use the string elongates up to about five degrees of rotation of the modulating member 140, the change in tune will not be aurally detectable.

For a stringed instrument such as a guitar, the most typical reason the instrument goes out of tune is that over time the strings stretch or otherwise relax, and thus the tone emitted by that string goes flat as the tension is lost. Stretching of the string and/or other factors such as friction at the guitar nut or bridge, and string interference when wound about the tuning pegs, or environmental factors such as humidity and heat, among other possible factors, can cause a string to elongate, and thus slacken.

In an instrument employing a mounting system 134 as discussed herein, as the string 50 elongates, the spring 138 maintains tension on the string 50, and thus counteracts slackening. More specifically, the force modulating member 140 rotates clockwise. Although such clockwise rotation may result in a decrease of the force exerted by the spring 138, the corresponding increase in lever arm 280 for spring operation assures that tension will remain at or near perfect-tune levels, as portrayed in the example plots of FIGS. 13-15. Since musical strings typically elongate only very short distances, a string tensioner 135 having a relatively small operating range, such as 10 degrees, 7 degrees, 5 degrees, or less, provides plenty of range for taking up the slack in the musical string as it elongates.

Notably, certain factors can cause the string to attempt to contract, and thus tighten. Such tightening may cause the string to go out of tune. The illustrated mounting system 134 also maintains an appropriate tension on the string 50 as the string contracts, thus counteracting tightening.

In a typical guitar, as a string elongates or attempts to contract, the string ends remain fixed, thus, a string that elongates becomes slack, and a string that attempts to contract tightens. In the illustrated embodiment, the second end 54 of the string is attached to the modulating member 140, which enables the second end 54 of the string to move. By allowing the second end 54 to move as the string elongates or contracts, but still applying an appropriate tension, the illustrated embodiment counteracts slackening and tightening.

Applicants have tested embodiments of structures for modulating spring forces. Such an analysis, though performed with an embodiment having features resembling that of FIG. 6, employs principles that can be used in embodiments having other structures. With reference again to FIG. 6A, distances and mathematical relationships of portions of the string tensioner 135 are represented schematically. This schematic representation will be used to discuss a specific example embodiment. For purposes of the discussion, the length 214 of the mount arm will be referred to as "a", the distance between the pivot point 198 and pin 262 will be referred to as "b", the length 278 of the spring will be referred to as "c", and the lever arm 280 of the spring will be referred to as "L". The angle between a and b will be referred to as θ; and the angle δ is a complementary angle to θ.

In one example:

a=0.95 in.;

b=1.45 in.;

$c_0$=spring free length=1.545 in.;

c=stretched length of spring (this parameter changes as the arm 200 rotates;

k=9.492 lb./in.; and spring pre-load=1.344 lb.

The tension T in the spring is calculated by: $T=k(c-c_o)+1.344$ lb. Also, per the law of cosines, $c^2=a^2+b^2-2ab\cos(\theta)$. Since $\theta=180-\delta$, $\cos(180-\delta)=-\cos(\delta)$. Thus: $c^2=a^2+b^2+2ab\cos(\delta)$, and $c=(a^2+b^2+2ab\cos(\delta))^{1/2}$.

Per properties of trigonometry, $L=b\sin(\alpha)$. Per the law of sines, $\sin(\alpha)/a=\sin(\theta)/c$, Thus, $\sin(\alpha)=(a/c)\sin(\theta)$. By trigonometric identities, $\sin(\theta)=\sin(180-\delta)=\sin(\delta)$. Thus, $\sin(\alpha)=(a/c)\sin(\delta)$. Solving for L: $L=(ab/c)\sin(\delta)$.

Using the mathematical relationships discussed above, Table A was prepared to show force characteristics of the sample embodiment relative to angle δ:

TABLE A

| δ(deg) | Spring Length c | c-c0 | Tension in Spring T | Lever length L | Torque (TL) at pivot 182 |
|---|---|---|---|---|---|
| 0 | 2.40000 | 0.855 | 9.45966 | 0.00000 | 0 |
| 2 | 2.39965 | 0.85465 | 9.456341 | 0.02003 | 0.18945 |
| 4 | 2.39860 | 0.85360 | 9.446385 | 0.04006 | 0.37843 |
| 6 | 2.39685 | 0.85185 | 9.429796 | 0.06007 | 0.56648 |
| 8 | 2.39441 | 0.84941 | 9.406579 | 0.08007 | 0.75315 |
| 10 | 2.39126 | 0.84626 | 9.376742 | 0.10003 | 0.93796 |
| 15 | 2.38036 | 0.83536 | 9.273261 | 0.14978 | 1.38892 |
| 20 | 2.36513 | 0.82013 | 9.128701 | 0.19920 | 1.81843 |
| 25 | 2.34561 | 0.80061 | 8.943374 | 0.24819 | 2.21965 |
| 30 | 2.32183 | 0.77683 | 8.717683 | 0.29664 | 2.58602 |
| 35 | 2.29385 | 0.74885 | 8.452119 | 0.34444 | 2.91127 |
| 40 | 2.26174 | 0.71674 | 8.147266 | 0.39149 | 3.18954 |
| 45 | 2.22555 | 0.68055 | 7.803797 | 0.43766 | 3.41542 |
| 50 | 2.18538 | 0.64038 | 7.422478 | 0.48286 | 3.58400 |
| 55 | 2.14131 | 0.59631 | 7.004167 | 0.52696 | 3.69091 |
| 60 | 2.09344 | 0.54844 | 6.549818 | 0.56985 | 3.73242 |
| 65 | 2.04189 | 0.49689 | 6.060482 | 0.61141 | 3.70546 |
| 70 | 1.98677 | 0.44177 | 5.537312 | 0.65152 | 3.60768 |
| 75 | 1.92822 | 0.38322 | 4.981566 | 0.69005 | 3.43751 |
| 80 | 1.86639 | 0.32139 | 4.394614 | 0.72684 | 3.19420 |
| 85 | 1.80142 | 0.25642 | 3.777948 | 0.76176 | 2.87791 |
| 90 | 1.73349 | 0.18849 | 3.133191 | 0.79464 | 2.48975 |

As shown in the data for the specific example presented above, the range of δ at which the torque applied by the spring to the pivot point 182 changes the slowest is between about 55-65°. Thus, preferably the above embodiment operates so that the string 50 is at a perfect-tune tension when the angle δ is between about 55-65°. Even more preferably, the embodiment is adapted to operate within a smaller range of angular change, such as less than about 5°. Further, this example shows that operating parameters, specifically the lengths a, b, and $c_0$, and any preloading of the spring, determine the range of degrees through which there is relatively small change in torque applied by the spring to the pivot point.

It is to be understood that a "sweet spot", or point at which the rate of change of the torque applied to the pivot point reaches zero, can be determined. Such a point can be calculated by finding the point at which T*L transitions from an increasing to a decreasing calculated value. Most preferably, the string mounting system is configured so that anticipated string elongation is confined to a range of arm rotation (less than 10° or, more preferably, less than 50) about this sweet spot in order to minimize the magnitude of the change in tension applied by the spring to the string upon elongation of the string. Such an operational range can be defined simply as an expected range of angular operation or can be mechanically determined by the device itself. For example, in the string tensioner 135 of FIG. 6, the stop engagement portion 220 engages the stop bolt 224 to prevent counterclockwise rotation beyond a particular angular position. In another embodiment, a forward stop engagement portion (not shown) extends from the modulating member and is adapted to engage the tensioner body 142 at a location forwardly of the elongate aperture 180 so as to prevent clockwise rotation beyond a desired angular position.

Additionally, it is to be understood that a diagram such as is depicted in FIG. 6A can be generated for many types and designs of lever-arm-type structures that may look different than the illustrated embodiment. For example, in the illustrated embodiment, pin 262 is the point of action of the spring that pulls on the end 212 of the mount arm 200, and the spring is mounted between pins 212 and 262. In other embodiments, the spring is not necessarily directly attached to pins 262 and/or 212, but acts on the arm mount 212 through the point labeled 262 via cables, pulleys, other members, special geometry, and the like.

The above example illustrates a design having a preferred operating range based on optimizing factors related to the distances a, b from mounts to the pivot point. It is to be understood that, in another embodiment, the radius 198 can also be varied over the preferred operating range so as to vary the effective moment of the cam portion 184 of the modulation member 140, thus counteracting the small changes in torque at the pivot 182. For example, in one embodiment that may be used in conjunction with properties such as disclosed above in connection with Table A, the radius 198 is lesser when $\delta$ is 60° than when $\delta$ is 55° or 65°. As such, the changing radius 198 compensates for the slightly increased torque (T*L) at 60° so that the tension applied to the musical string 50 is even closer to a constant magnitude.

In still another embodiment, instead of or in addition to a lever-arm-type spring structure as described above, the cam 184 may be replaced by a spiral-tracked conical cam structure, similar to a fusee, that can compensate for a changing applied force by providing a corresponding change in effective moment arm for applying the force to the musical string.

Applicants have had marked success in employing the structure just described above in connection with FIGS. 5-15. Specifically, the mechanical structure 140 interposed between the spring and the string modulates the relationship between the force exerted by the spring and the tension actually applied to the string so that they are not linearly related. Further, the mechanical structure provides a relatively simple and easily constructed structure that will fit within the compact confines of a typical musical instrument such as an electric or acoustic guitar. However, it is to be understood that Applicants contemplate that other types or forms of mechanical structures interposed between a spring and a corresponding musical string can also modulate the effect of forces exerted by the spring on the corresponding string. More specifically, Applicants contemplate that other mechanical interface structures can effectively flatten a string tension curve relative to its corresponding spring's tension curve by using various mechanical structures, such as cams, lever arms, pulleys, gears, or the like in various configurations.

In order to tune an embodiment as depicted in FIG. 6, preferably the shuttle 250 of the string tensioner 135 is first positioned at an ideal position for the tension of the corresponding musical string 50. As such, when the string 50 is connected to the force modulating member arm 200, strung over the string receiver 190 and into the tuning knobs 48 of a guitar, and then tightened, it will achieve ideal tune when at a position very similar to that depicted in FIG. 6, which shows the tensioner reference tip 234 aligned with a preferred tune reference mark 230A on the string cam 184 of the modulating member 140. However, in order to fine tune the positioning of the shuttle 250 for a particular string tension, the user may use an iterative process in which the shuttle 250 is moved and tuning knobs 48 are correspondingly moved so that perfect tune is achieved at a point when the tensioner body indicator tip 234 is aligned with the preferred reference line 230A of the cam portion 184. Although the shuttle 250 position is adjustable, it preferably remains in a fixed position during play and after initial tuning.

Another preferred method of tuning can be performed without first adjusting the shuttle 250. In this embodiment, the string is first tuned in a manner as with a conventional guitar. During this process, the forward or rear stop engagement portion 220 usually engages, preventing rotation of the modulating member 140 and removing the spring from consideration in string tuning. Once the string is appropriately tuned, the shuttle is adjusted until the stop engagement portions are no longer engaged.

As such, a visual indicator of perfect tune is provided. As discussed above, during play, as the string 50 elongates and the string tensioner 135 compensates for such elongation without substantially changing the actual string tension, the fact that string elongation has occurred will be visually and mechanically reflected since the tip 234 will no longer be aligned with the preferred line 230A, thus indicating a change in angular position of the modulating member 140. Thus, a musician will be able to tell when the string 50 has stretched by observing the visual indicator, even though the string pitch or tune likely will not have changed to a magnitude that is audibly detectable by the human ear. By periodically checking his instrument, the musician can detect when a string 50 has moved from the perfect tune position, and will be able to use the tuning knobs 48 to incrementally tighten the string 50 to return the string 50 to the perfect tune position indicated by the aligned tip 234 and reference line 230A.

One popular guitar playing method is for the guitarist to "bend" notes during play. This is accomplished when the musician pushes a string 50 against the fretboard 42, and then further deflects the string relatively radically, thus changing the tension of the string 50 and correspondingly changing the note emitted by the string. In a preferred embodiment, after the instrument has been tuned, the user tightens the stop bolt 224 to a point where an end of the stop bolt 224 is near but either slightly spaced from or barely engaging the corresponding stop engagement arm 220. As such, when a guitarist bends notes by radically deflecting the strings 50, rather than rotating the modulating member 140 counter-clockwise, and thus cancelling or muting the bend effect, the engagement arm 220 will engage the stop bolt 224, preventing such counter-clockwise rotation. Thus, the spring 138 is removed from consideration and prevented from softening the bend effect, and a guitarist can obtain a substantial note bending effect through normal play.

In yet another embodiment, an arrangement may be provided to aid in setting the position of the stop bolt 224. In this embodiment, the stop bolt is electrically energized. An electrical contact is disposed on the stop engagement arm 220 and aligned with the bolt so that when the bolt touches the contact an electrical circuit is completed. Completion of the electrical circuit generates a signal. Such a system may be especially helpful when setting the position of the stop bolt. For example, an electric guitar may have a bend stop setting in which detection of the signal indicating completion of the electric circuit results in some effect, such as cutting off the signal to the amplifier, actuation of a lighting or aural effect, or the like so that the user will know that the arm 220 and bolt 224 are engaged. The user then backs the bolt 224 just until the signal stops, indicating that the arm 220 and bolt 224 are not engaged, but are positioned very close to one another. In this position, engagement of the arm 220 and bolt 224 is nearly instantaneous when the guitarist deflects strings to get the bending effect. After setting the arm 220 and bolt 224 position, the guitar setting preferably is changed so that, during play, the signal does not interfere with play.

In another embodiment, the arm 220 and bolt 224 may be intentionally set relatively far from each other so that the bend effect is, generally, avoided. Such a setting may be particularly preferred by beginner guitarists who, due to inaccurate finger positioning, may unintentionally bend notes, resulting in a too-sharp emitted note.

In still another embodiment, an electrical circuit that is selectively completed when the bolt 224 and arm 220 are engaged may be employed to intentionally trigger certain effects during a performance. For example, in one embodiment, completion of the circuit may trigger an aural effect, such as automatically triggering the distortion effect of the electric guitar and/or amplifier. In another embodiment, lights such as LEDs may be attached to the guitar, and completion of the circuit may trigger a visual effect such as temporarily turning on some or all of the LEDs.

In still another embodiment, the guitar may be electronically connected, via wire or wireless connection, to a computer system, and completion of the circuit may be detected by the computer system, which may control other effects. For example, in a stage show, certain lighting, pyrotechnic, or other effects may be computer-controlled. Upon detection of a signal from the guitar indicating string bending, the computer system thus can generate a lighting or other effect to enhance the aural effect already being generated by the guitar.

In yet another embodiment, a contact on the arm 220 includes a pressure sensitive transducer so that the signal generated upon completion of the circuit can also include an indication of the intensity of the bending effect. Each of the above-discussed embodiments may accordingly be enhanced and modified depending on the sensed intensity of the bending effect.

It is to be understood that various electrical circuit configurations may be employed to both electrically indicate engagement of the bending effect and the intensity of the effect. It is also to be understood that the guitar, amplifier, or other equipment preferably is set up to allow a user to change the setting between a setup configuration, no-effect configuration, and/or special-effect configuration, or other desired configurations.

Figure 16:
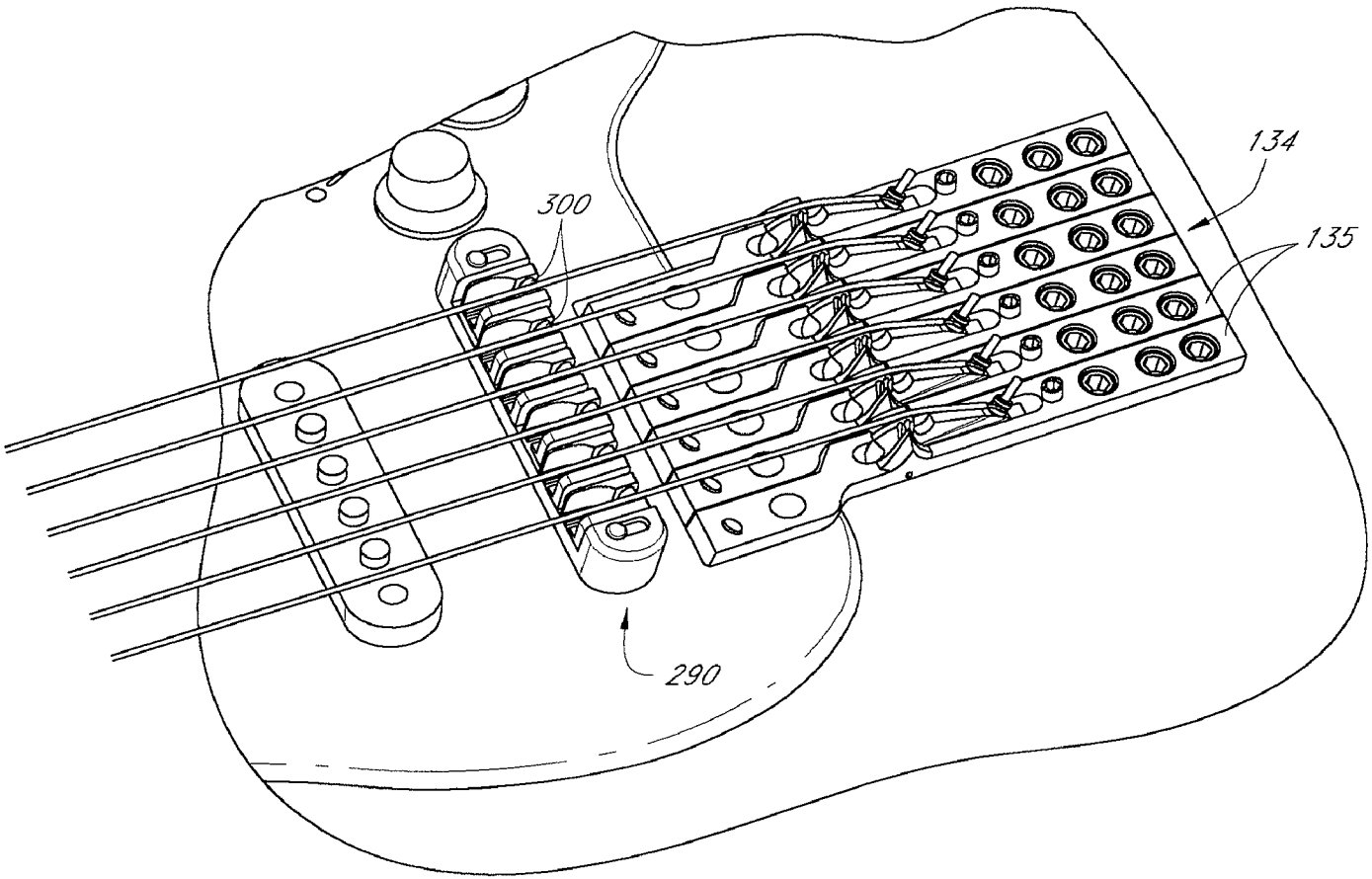
FIG. 16 is a perspective view of another embodiment of a guitar employing an embodiment of a string tensioning system having aspects of the present invention.
Figure 17:
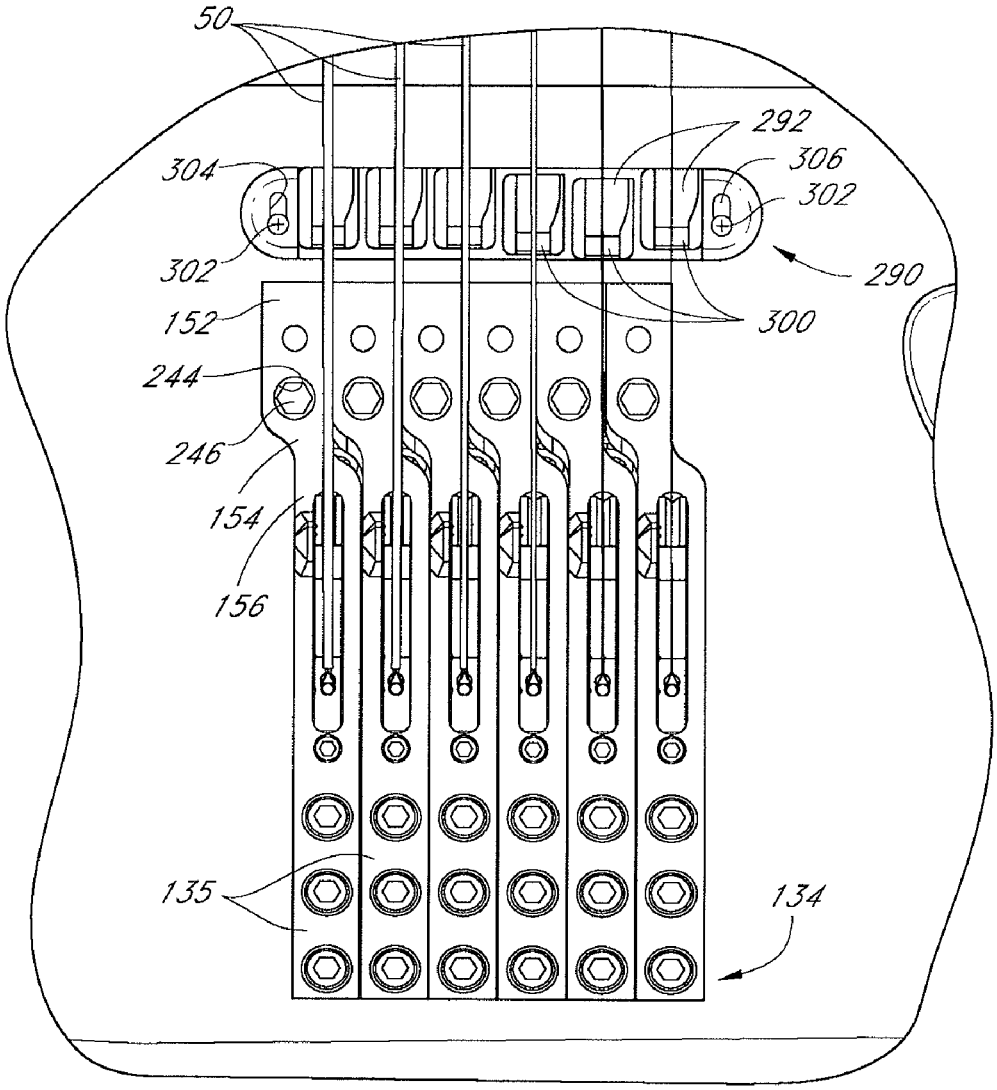
FIG. 17 is a top view of the guitar of FIG. 16.

In the embodiment depicted in FIGS. 5-12, the guitar 130 is provided without a separately formed bridge. In this embodiment, the string receiver 190, specifically the saddle 192, functions as a bridge. With reference next to FIGS. 16 and 17, a separate bridge 290 may be interposed between the string tensioners 135 and a playing portion 63 of the tightened strings 50. In the illustrated embodiment, the bridge 290 comprises a plurality of bridge members 292, each having a roller 300 adapted to function as a bridge for a corresponding string. In one embodiment, each bridge member 292 and corresponding roller 300 is adjustable over a short range so that the position of the roller 300 relative to the string 50 and other rollers can be adjusted if desired. Additionally, the illustrated bridge 290 is attached to the guitar body 32 by fasteners 302 that extend through first and second apertures 304, 306. The first and second apertures 304, 306 are elongate so that, upon loosening of the fasteners 302, the entire bridge 290 may be moved longitudinally and then retightened in a desired position. It is to be understood that guitar bridges having various structures, including non-adjustable structures that use structures other than rolling bridge members, may also be used in accordance with preferred embodiments.

Figure 18:
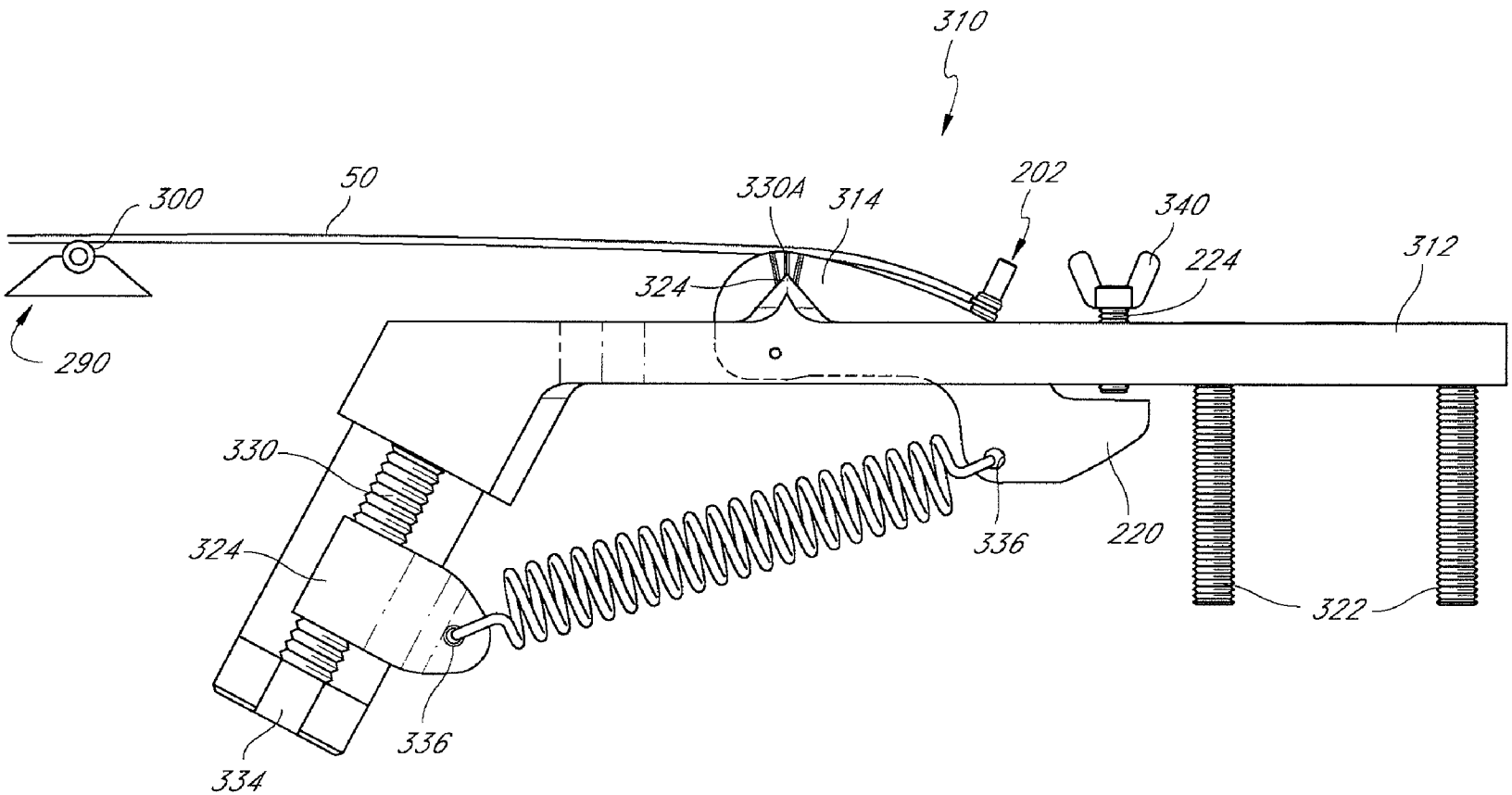
FIG. 18 is a side view of yet another embodiment of a string tensioner having aspects in accordance with the present invention.
Figure 19:
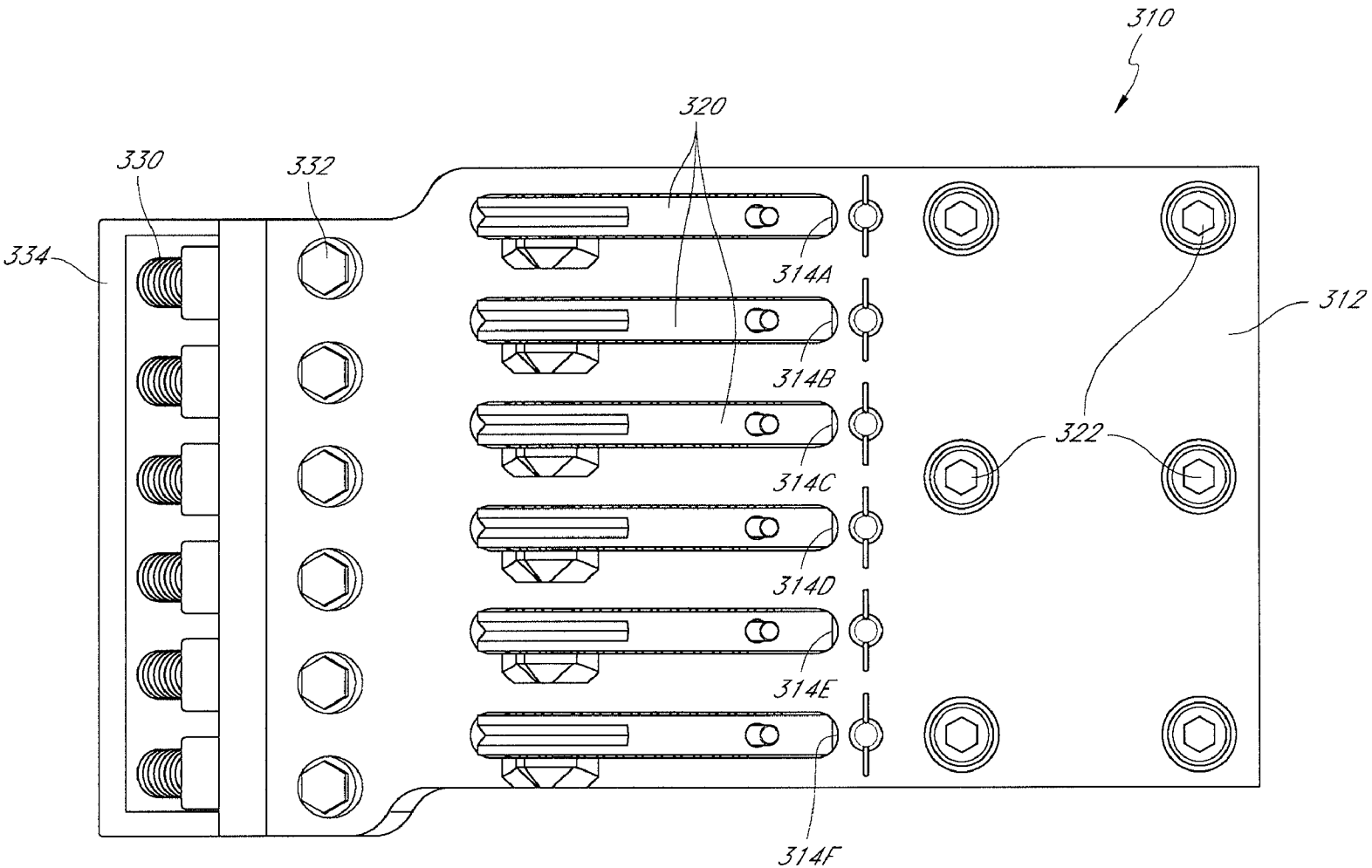
FIG. 19 is a top view of another embodiment of a string mounting system employing tensioners as in FIG. 18.

With reference next to FIGS. 18 and 19, another embodiment of a string tensioner 310 is provided. This embodiment is also adapted for use with a guitar. In this embodiment, the string tensioner 310 comprises a single frame 312 adapted to be used to tighten six adjacent musical strings. The single frame 312 employs six elongate apertures 314. A force modulating member 320 is pivotally mounted in each elongate aperture 314. Mounting fasteners 322 are provided to attach the frame 312 to a guitar body.

The illustrated string tensioner 310 operates on principles similar to those employed in the embodiment discussed above, but may have different structure. For instance, the illustrated embodiment includes a shuttle 324 riding over an adjustment bolt 330 and not having a separate guide member. Preferably, the adjustment bolt 330 is rotatably secured adjacent the bolt head 322 and adjacent a distal end 334 of the bolt 330. The shuttle 324 moves linearly as the bolt 330 is rotated. Additionally, rather than employing a pin for mounting of the spring ends, the shuttle 324 and the force modulating member arm 320, both comprise an aperture 336 through which ends of a coiled tension spring 138 can be inserted.

Further, embodiments described above showed the stop bolt 224 as having a hex bolt construction requiring a tool for adjustment. In the illustrated embodiment, the stop bolt comprises a winged head 340 that can be easily hand-adjusted without using of tools. This or other constructions can be used for other structures. For example, in another embodiment the adjustment bolt 330 may be adapted to be adjustable without the use of separate tools and/or may be accessible for adjustment through the back of the guitar. In still another embodiment, the guitar may be modified to have a tool receiver portion or cavity sized and adapted to store an adjustment tool for adjusting the adjustment bolt and/or other components so that the tool is always with the instrument.

In accordance with yet another embodiment, a roller bridge 340 may be provided having a roller structure 342 dedicated to each string 50. Preferably, the roller structures 342 are adapted to generate very little friction during use. As such, an embodiment is contemplated in which each roller structure 342 comprises a roller 344 adapted to rotate about an axle 346 that is rotatably mounted in an axle support member 348. In one embodiment illustrated in FIG. 18, the axle 346 has a small diameter, such as about 0.030 in., and the roller 344 has a relatively large diameter, such as about ¾ in. As such, a ratio of the roller diameter to the axle diameter is about 25. An embodiment having such a ratio can be expected to have relatively small friction losses during relatively small rotations such as when checking and modifying tune of a musical instrument employing string tensioners 135, 310 as discussed herein. Preferably, a low-friction roller bridge is provided having a roller diameter to axle diameter ratio greater than about 10; more preferably greater than about 15; and still more preferably greater than about 20.

In the embodiment illustrated above in connection with FIGS. 5-12, the line of action 270 of the spring 138 operates about a lever arm distance 280 that is greater than a lever arm distance 198 of the string cam member 184. As such, the spring 138 has a mechanical advantage, and thus is capable of exerting a tension on the string 50 that is greater than the force generated by the spring 138. This structure enables a smaller, lighter and less expensive spring to be employed than if there were an end-to-end connection between the string and the spring. This also facilitates a structure in which the line of action 270 of the spring 138 is in a direction generally transverse to the corresponding string 50. It is to be understood that several different structural designs may employ the inventive principles taught by this embodiment, but may look quite different than the illustrated embodiment.

In still another embodiment, a single spring can apply tension to two or more strings simultaneously. In embodiments in which the corresponding musical strings are designed to operate at different string tensions, a different lever arm distance preferably is provided in the corresponding force modulating member 140 so that the same spring can apply differing actual tensions to the corresponding strings. Preferably, the rate of change in operating lever arm of the spring as the modulating member rotates is identical for both strings so that the magnitude of force actually applied to the strings changes uniformly for each of the attached strings.

The illustrated embodiments have employed coil-type springs to apply tension to the strings. It is to be understood, however, that various other types and configurations of springs may be employed. Further, the term "spring" should be understood to be a broad term including embodiments as discussed above, and, generally, structures that can store and mechanically impart energy, or force, upon a string directly or through a mechanical interface, and may include a single spring member or a plurality of members that work together in some way.

For example, gas springs can be employed to provide appropriate tension while maintaining compact size. Several gas spring options are available, and such gas springs can be obtained from McMaster-Carr and other manufacturers. Another capable example is a flexible bar or the like that may function as a spring. Such a bar could even have a unique geometry resulting in specially-tailored spring action directions that inherently create a moment arm relative to a connection point, thus including spring and force modulation in a single member.

Figure 20:
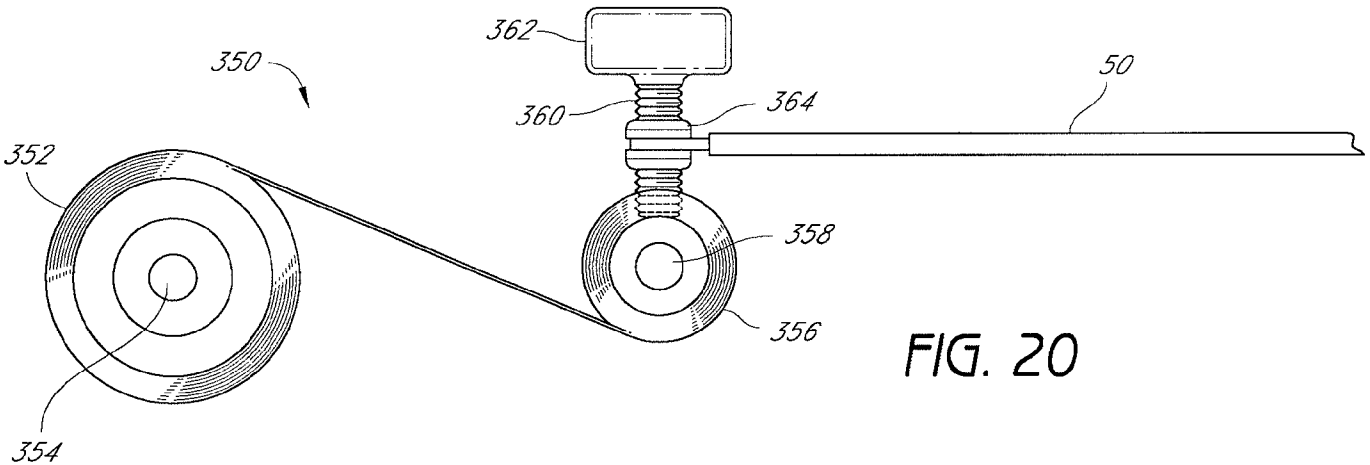
FIG. 20 is a schematic view of another embodiment of a string mounting system having aspects in accordance with the present invention.

With reference next to FIG. 20, another embodiment is provided in which a constant torque spring, such as the NEG'ATOR Constant Torque Spring Motor, which is available from Stock Drive Products/Sterling Instrument, can be mechanically connected to a musical string and configured to apply a substantially constant tension to the string. In the illustrated embodiment, the constant torque spring motor 350 comprises a first coil 352 mounted to the musical instrument at a first mount 354, and a second coil 356 that is mounted to a rotatable bar 358. A threaded lever arm 360 extends from the bar 358 and has a knob 362 adapted so that the arm 360 can be rotated. A shuttle 364 is disposed over the threaded arm 360, and a musical string 50 is attached to the shuttle 364. As such, the constant force spring 350 applies a substantially constant torque to the bar 358, which in turn exerts a constant tension on the string 50 by way of the lever arm 360. Since the lever 360 is adjustable, a user may vary the effective moment arm of this arrangement, and thus custom-tune the tension actually applied to the string by the constant force spring motor 350.

Figure 21:
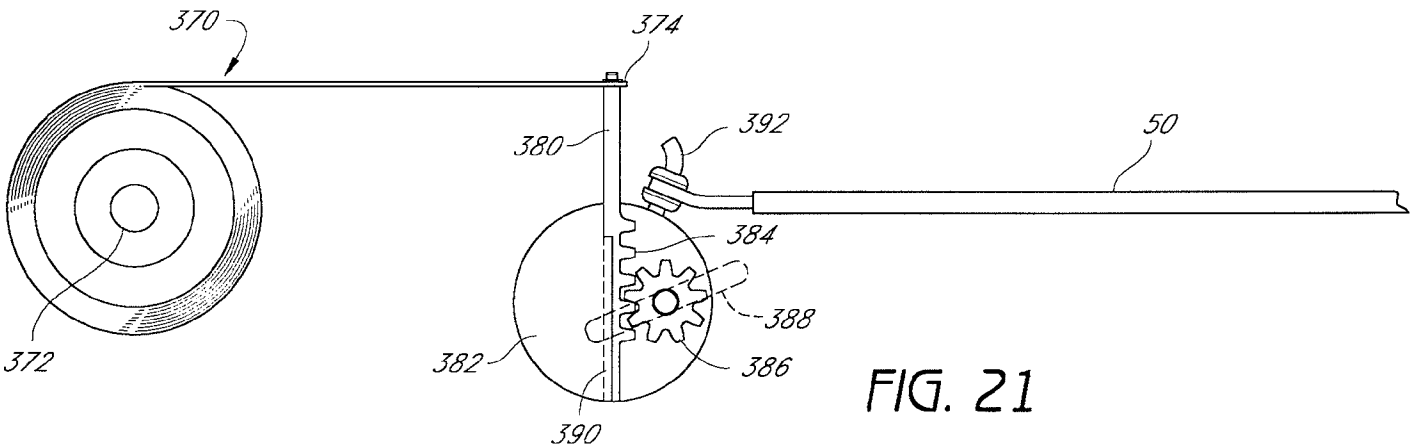
FIG. 21 is a schematic view of yet another embodiment of a string mounting system having aspects in accordance with the present invention.

With next reference to FIG. 21, a constant force spring 370, such as is available from Vulcan Spring & Mfg. Co. of Telford, Pa., comprises a single roll of pre-stressed spring steel having a mount 372 attached to the body of the musical instrument. An attachment end 374 of the spring is attached to a lever arm 380, which is slidably mounted onto a rotatable bar 382. In the illustrated embodiment, a portion of the lever arm 380 has a plurality of gear teeth 384. A rotatable gear 386 is mounted onto the bar 382, and is actuable by a user via a knob 388. When the knob 388 is twisted, the gear teeth engage, sliding the arm 380 and changing the effective moment arm length of the lever 380. In the illustrated embodiment, a track portion 390 of the bar 382 contains the lever arm 380 in place.

With continued reference to FIG. 21, a second lever 392 is also provided on the bar 382, and the musical string 50 is attached to the second lever 392. As such, the constant force spring 370 applies a substantially constant force which has a mechanical advantage or, in other embodiments, disadvantage relative to the string 50. Also, by adjusting the effective moment arm length of the lever 380, the user can fine tune the tension that is applied to the string 50 in order to attain and maintain a desired tune.

Due to the rolled structure of the constant force spring 370, the applied force of the spring varies very little from its rated level, such as less than about 1% over 20%, 40%, 60%, 80% or more of its length of operation. As such, a constant force spring can provide a consistent application of force so as to provide a consistent, near constant tension to the musical string 50, thus enabling the string to keep substantially the same tension, and thus tune, even when the string elongates or contracts.

Although the above embodiments employ moment arms, it is to be understood that a constant force spring having a specific desired output force may be attached end-to-end with a corresponding musical string in order to apply a desired tension force to the string. The constant force spring preferably is chosen to apply the desired tension without force modulation between the spring and the string.

Although the illustrated embodiments have employed adjustable levers, it is to be understood that other structures, such as a variable radius pulley, can also be used to provide an adjustable moment arm so as to fine tune the precise tension exerted by the spring on the associated musical string.

Figure 22:
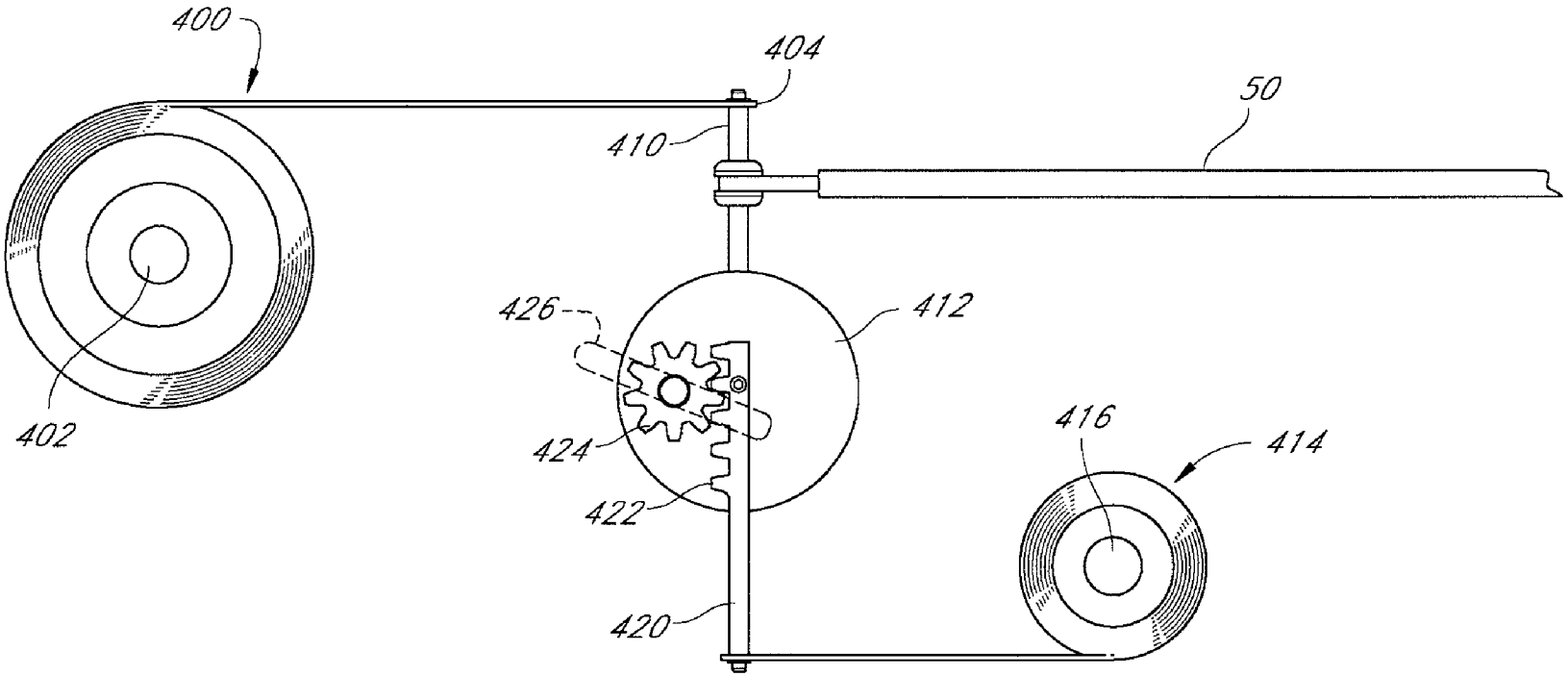
FIG. 22 is a schematic view of still another embodiment of a string mounting system having aspects in accordance with the present invention.

With reference next to FIG. 22, yet another embodiment is provided in which two springs 400, 414 operate on a single musical string 50. In the illustrated embodiment, a first constant force spring 400 is attached at a first mount 402 to the instrument body and has an attachment end 404 attached to a first lever 410. The string 50 is also attached to the first lever 410, which is adapted to rotate with a rotatable rod 412. A second spring 414 is attached to the musical instrument body at a second mount 416 and is also attached to a second lever 420 having an adjustable moment arm length by, for example, providing teeth 422 on a portion of the lever arm 420 and having a gear 424 with a user-operable knob 426 for adjusting the effective moment-arm length of the lever arm 420.

In the embodiment illustrated in FIG. 22, the first spring 400 is adapted to provide the majority of the tension to the associated string 50. For example, if the nominal desired tension of the string is about 21 pounds, the first constant torque spring 400 may be adapted to provide, through the lever arm 410, 20 pounds of tension, while the second spring 414 is adapted to provide, via the lever arm 420, about 2 pounds of tension. As such, the two springs working in concert provide the desired tension of the associated string 50. However, since the second spring 414 is smaller, it can be provided with more precise loading and adjustment characteristics so as to aid in easily adjusting and tuning the tension actually exerted on the string.

In another embodiment, the second spring may be a different type of spring, such as a coil-type spring. Also, the second spring may be attached to the string 50 in a manner similar to the illustrated embodiment, or through some other type of force modulating member. Since the second spring is relied upon for only a relatively small magnitude of tension, a coil spring having a relatively small spring constant may be chosen. Such a spring would have a lesser change in magnitude over a particular range of string elongation or contraction. As such, the concept of using multiple springs working together increases the options available to string mounting system designers.

Figure 23A:
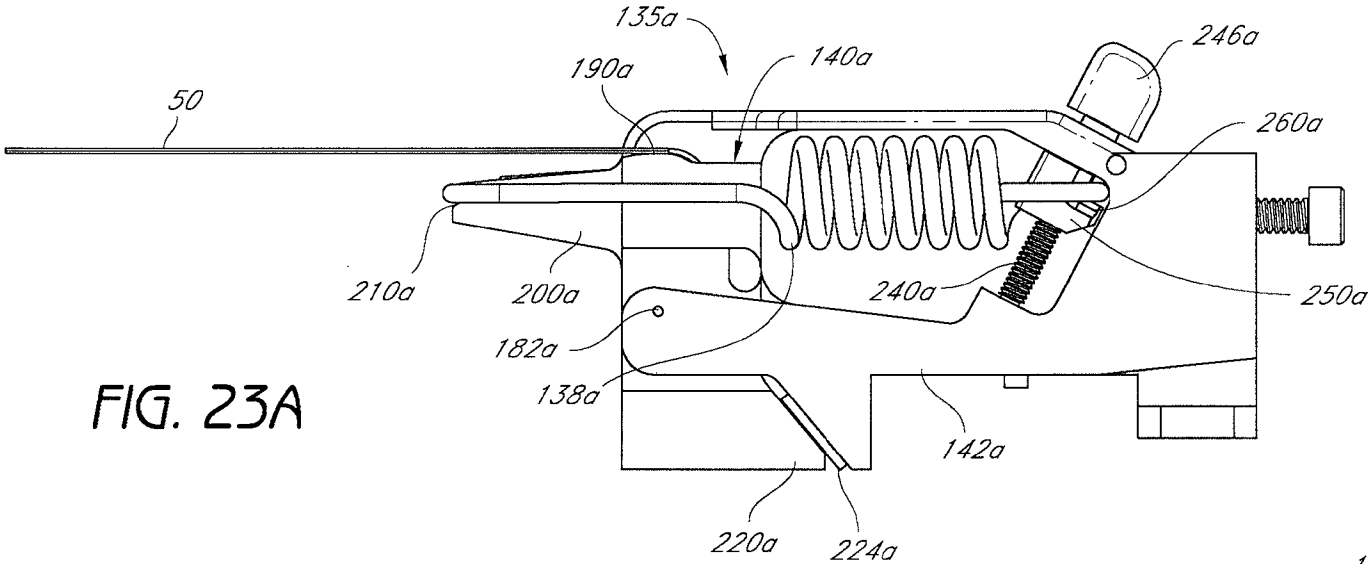
FIG. 23A is a side view of yet another embodiment of a string tensioner having aspects in accordance with the present invention
Figure 23B:
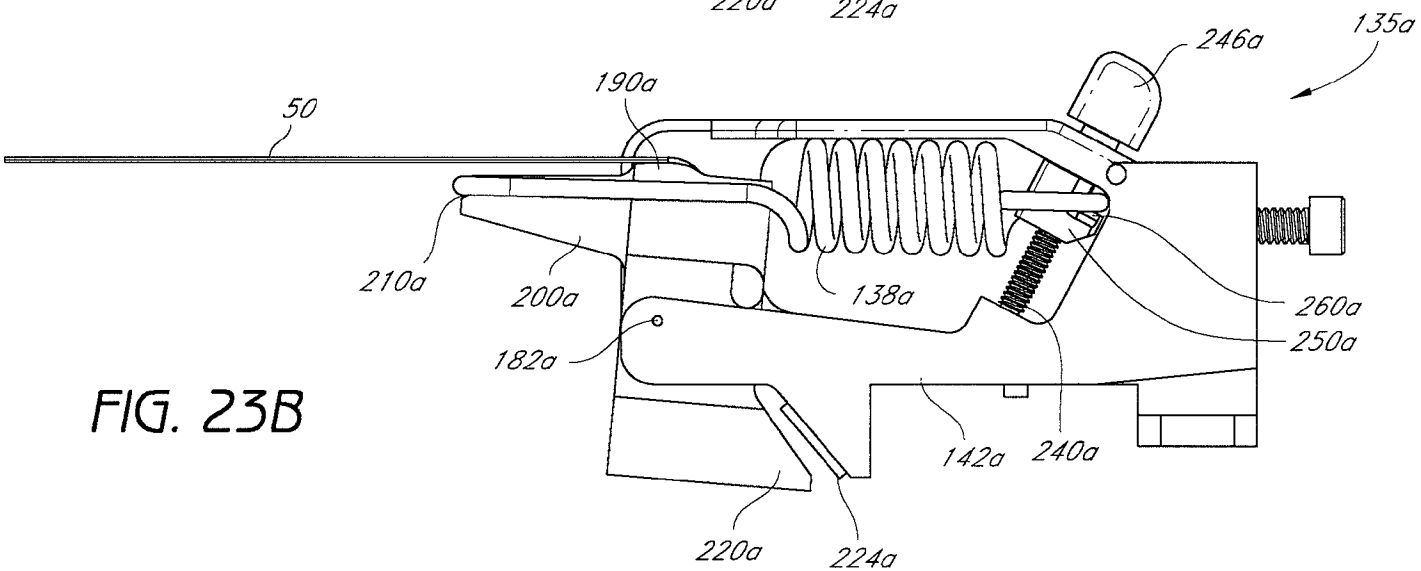
FIG. 23B is a side view of the string tensioner of FIG. 23A showing the spring force modulating member portion in a different rotational position.

With reference next to FIGS. 23A and 23B, yet another embodiment of a string tensioner 135*a* is provided. In this embodiment, the string tensioner comprises a body 142*a* that supports a spring force modulating member 140*a* that is adapted to rotate in a limited range about a pivot 182*a*. The modulating member 140*a* comprises an arm 200*a* having a string receiver 190*a* is adapted to receive and support a musical string 50. The arm 200*a* also includes a spring mount 210*a* adapted to engage a first end of a spring 138*a*.

The body portion 142*a* supports a threaded adjustment bolt 240*a* upon which a shuttle 250*a* is arranged. The longitudinal position of the shuttle 250*a* along the bolt 240*a* can be adjusted by rotating the bolt using the knob 246*a*. The shuttle 250*a* includes a spring mount 260*a* adapted to receive a second end of the spring 138*a*.

In this embodiment, the force modulating member 140*a* rotates about the pivot 182*a*, and force from the spring 138*a* is modulated and provides tension to the string 50 in a manner functionally similar to the embodiment discussed in connection with FIGS. 5-12. A stop engagement portion 220*a* of the modulating member 140*a* is adapted to engage a stop surface 224*a* formed on the body 142*a* so as to limit the range of rotation of the modulating member 140*a*. FIG. 23A shows the tensioner with the stop 220*a* engaged, and FIG. 23B shows the tensioner 135*a* rotated away from the stop 220*a*.

With reference next to FIGS. 24 to 28, yet another embodiment of a string tensioner 135*b* is shown. As with some other embodiments discussed herein, the illustrated tensioner 135*b* comprises a body 142*b* that supports a spring-force modulating member 140*b*. The force modulating member 140*b* is adapted to rotate relative to the body about a pivot 182*b*. Notably, in the illustrated embodiment, a musical string 50 supported by the string tensioner 135*b* engages a saddle portion 500, and extends generally upwardly from the saddle 500 to a string anchor 502.

Figure 24A:
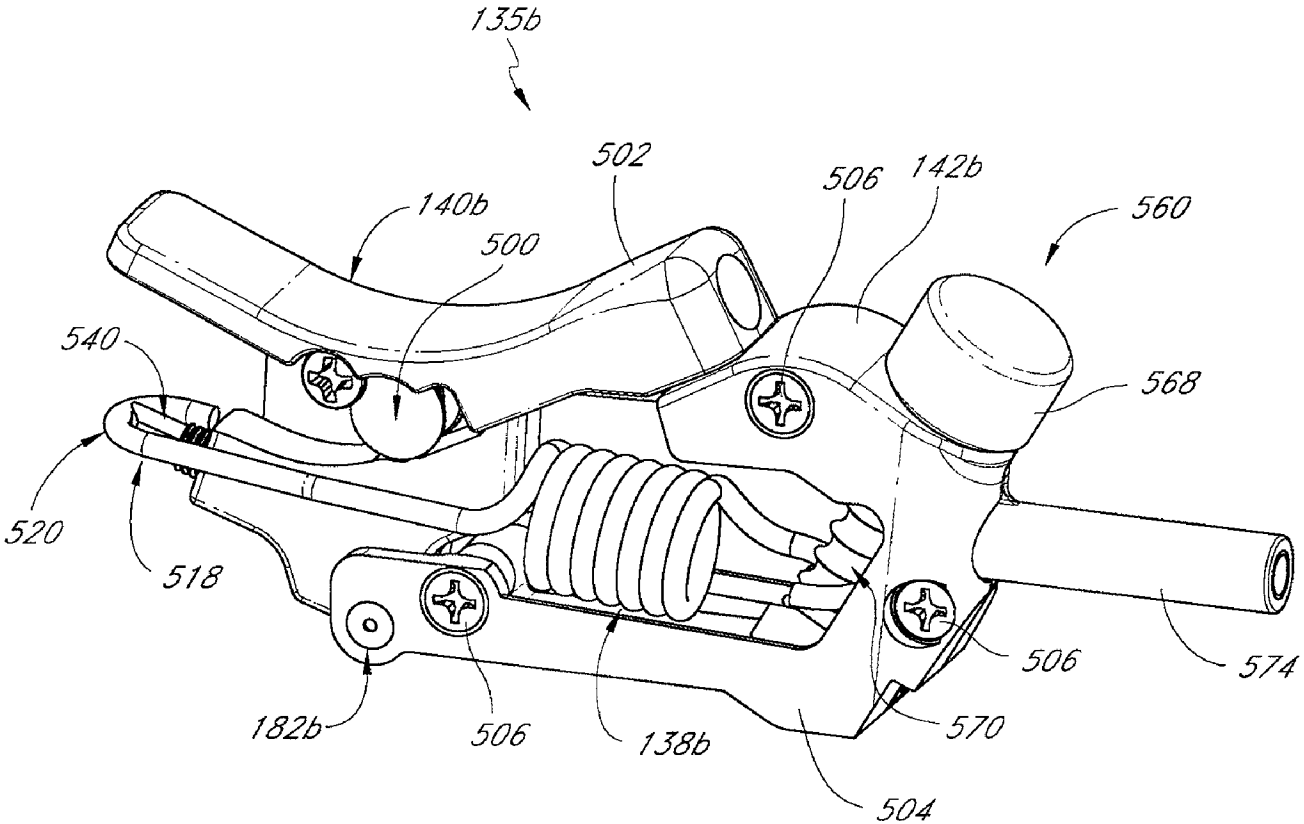
FIG. 24A is a perspective view of yet another embodiment of a string tensioner having aspects in accordance with the present invention.
Figure 24B:
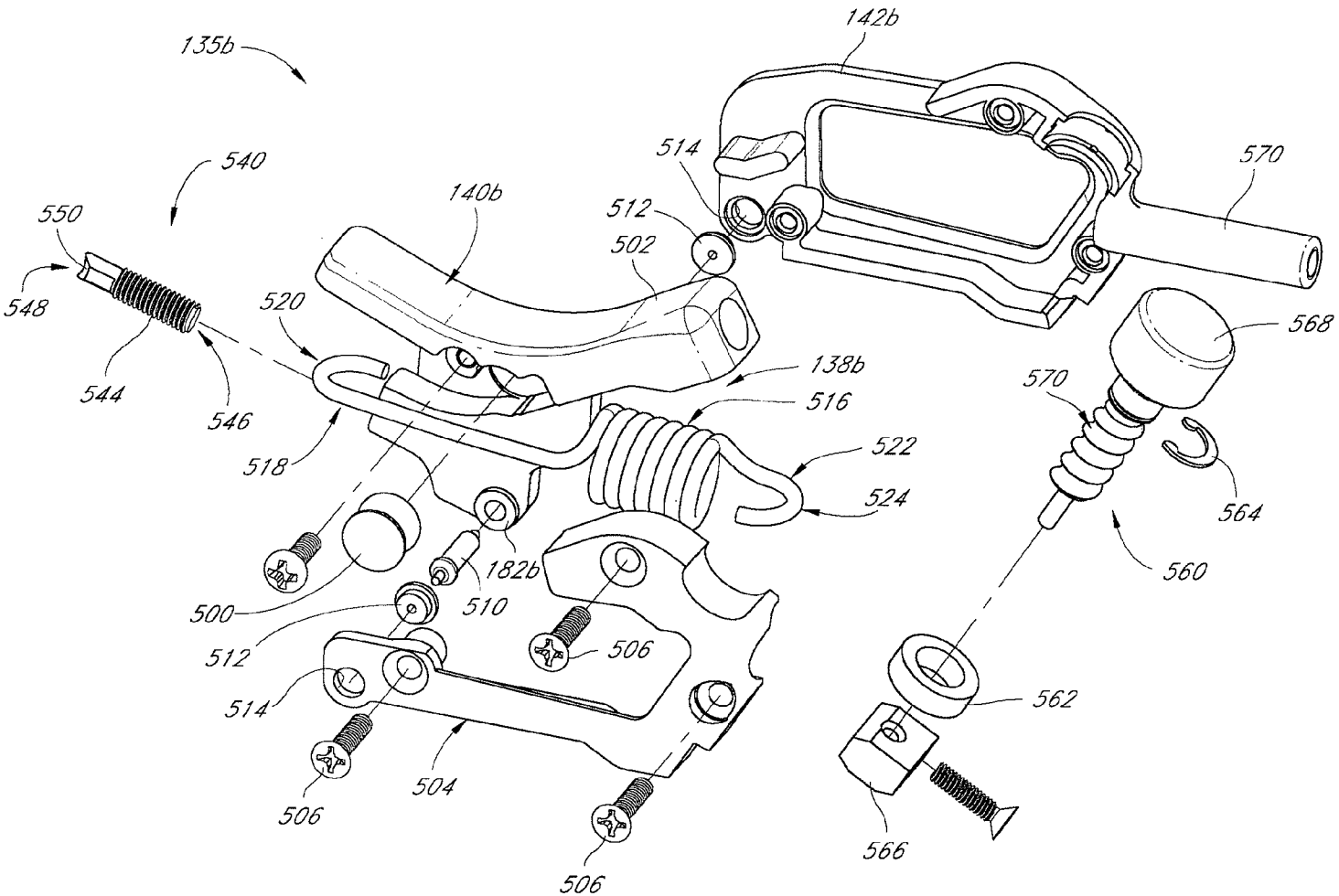
FIG. 24B is an exploded view of the embodiment of FIG. 24A.

With particular reference to FIGS. 24A and 24B, the body 142*b* preferably provides a space for accommodating components of the string tensioner and has a body cover 504 that at least partially encloses such components in the space. Fasteners 506 secure the body cover 504 to the body 142*b*. In the illustrated embodiment, the force modulating member 140*b* has a pivot 182*b* adapted to accommodate an axle 510 extending therethrough. Axle bushings 512 are supported by apertures 514 formed through the body 142*b* and body cover 504, and the axle bushings 512 support the axle so as to accommodate rotation of the force modulating member 140*b* about the pivot 182*b* in a low friction, efficient manner. As in other embodiments, a spring 138*b* connects to both the body 142*b* and the force modulating member 140*b*, and extends therebetween. In the illustrated embodiment, the spring 138*b* comprises a coil spring having a coil portion 516, an elongate first connection portion 518 with a first end 520, and a second connecting portion 522 with a second end 524. Preferably, the connecting portions are generally hook-shaped at the first and second ends 520, 524 to assist in mounting the spring 138*b*.

Figure 25:
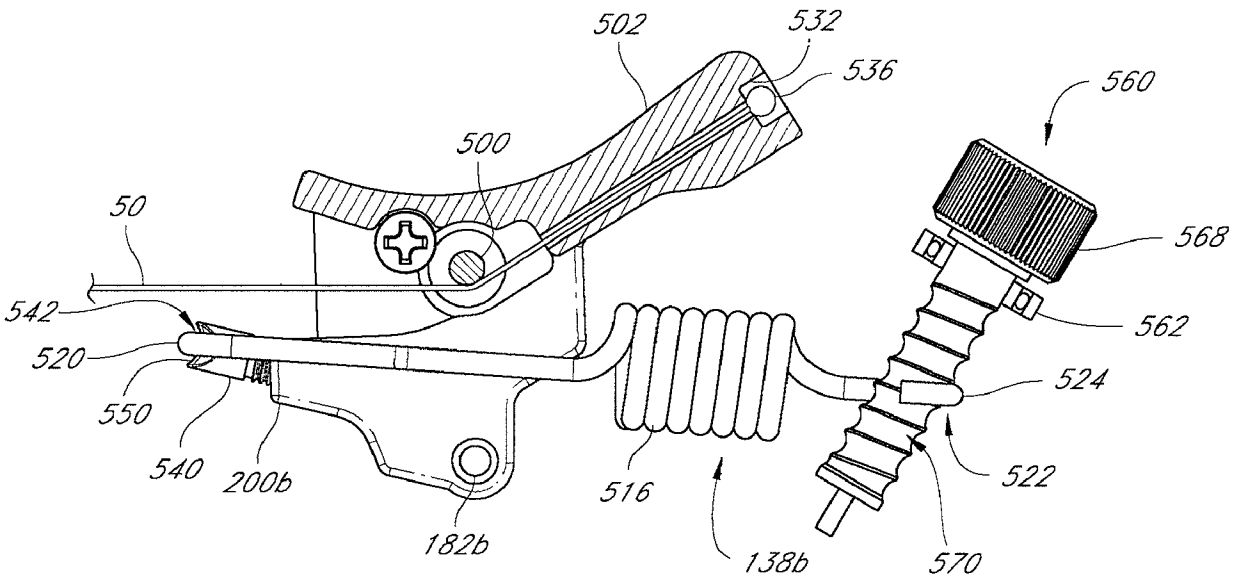
FIG. 25 is a partially cutaway view of some components of the embodiment of FIG. 24A showing mounting of a musical string.
Figure 27:
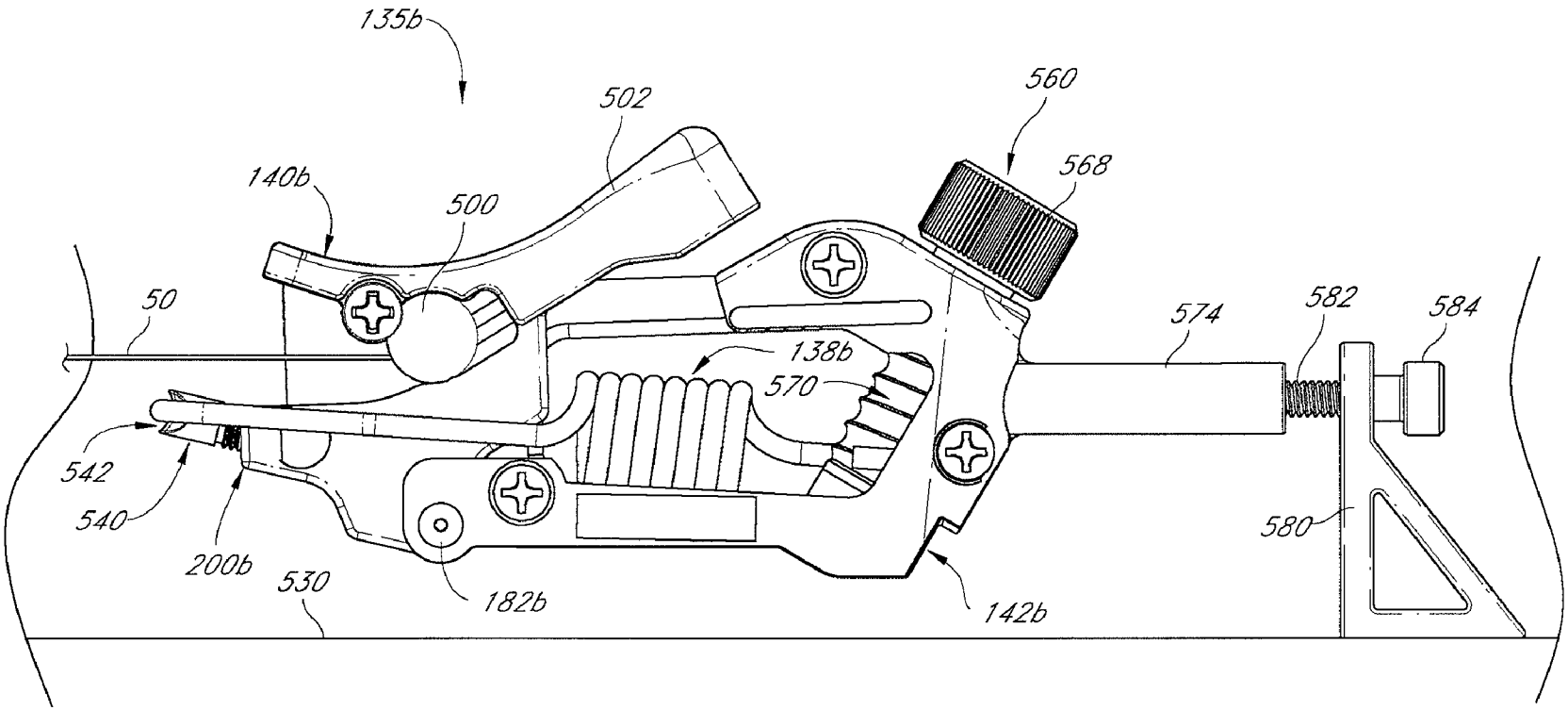
FIG. 27 is a side view showing the embodiment of FIG. 24A mounted on a musical instrument in accordance with one embodiment.

With specific reference to FIGS. 24, 25 and 27, a saddle 500 adapted to accommodate a musical string 50 is supported by the force modulating member 140*b*. Notably, in the illustrated embodiment the saddle 500 is positioned on a side of the string generally opposite the face 530 of the instrument. An anchor portion 502 of the force modulating member 140*b* extends generally upwardly from the saddle 500 and comprises an anchor receiver 532. As best shown in FIG. 25, the musical string 50 is supported, from above, by the saddle 500, and at the saddle the string 50 bends and then extends toward the anchor receiver 532. An anchor 536 of the string 50 is held in the anchor receiver 532. Preferably, knobs 48 on the guitar head 36 secure free ends of the string 50 so that the string is secured between the knobs 48 and the anchor receiver 532. In this manner, the musical string 50 is supported at the saddle 500, and then extends generally upwardly to the anchor portion 502. In a preferred embodiment, no other bridge is provided on the guitar so a playing zone of the string 50 is defined between the saddle 500 and the nut 46 of the guitar.

Figure 26:
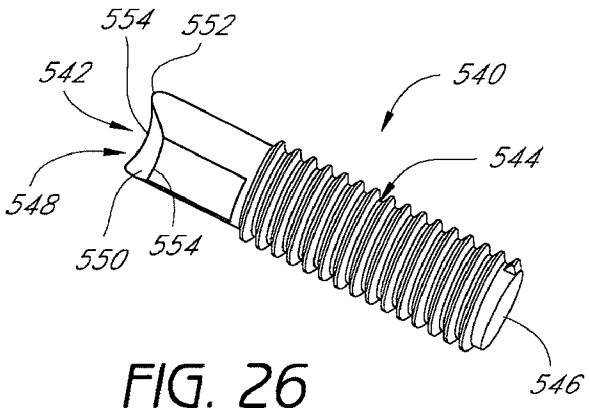
FIG. 26 is a perspective view of a component of the embodiment of FIG. 24A.

With additional reference next to FIGS. 25 and 26, the force modulating member 140*b* preferably has an arm 200*b* that supports a front adjuster 540 comprising a spring mount 542. In the illustrated embodiment, the front adjuster 540 is an elongate rod that is threaded along a portion 544 of its length beginning from a first end 546. The spring mount 542 is provided at a second end 548 of the front adjuster 540. Preferably, the arm 200*b* comprises a threaded aperture adapted to accommodate and support the threaded portion 544 of the front adjuster 540. As such, the position of the front adjuster 540 can be customized so as to enable custom adjustment of the effective length of the arm 200*b*.

A spring mount engagement surface 550 preferably is adapted to accommodate high forces between the spring 138*b* and the engagement surface 550 and to minimize friction between these surfaces when the force modulating member pivots relative to the body 142*b*.

In the illustrated embodiment, the spring mount engagement surface that is generally saddle-shaped. More specifically, the engagement surface 550 preferably has a geometrically shape defined by a first and a second arcuate curve 552, 554. The first arc 552 curves generally about a first axis, and the second arc 554 curves about an axis transverse to the first axis. The second arc 554 is translated along the first arc 552 to define the engagement surface 550 as shown in FIG. 26.

Continuing with reference to FIGS. 24A and 26, the first arcuate curvature 552 preferably is adapted to generally accommodate the curvature of the hooked first end 520 of the spring. The second arcuate curvature 554 preferably accommodates the round, cross-sectional first end 520 of the spring 138*b* as the arm 200*b* pivots during use and the angle of contact between the spring 138*b* and the engagement surface 550 changes accordingly. This configuration helps minimize friction between the spring 138*b* and the engagement surface 550 as the force modulating member 140*b* pivots. Applicant has learned that such frictional forces between the spring and engagement surface can interfere with smooth operation of the string tensioner 135*b* as the musical string 50 tightens and slackens.

To further reduce friction during operation, at least the engagement surface 550 of the spring mount 542 preferably comprises a hardened material, preferably having a hardness between about 55-62 HRC. In a preferred embodiment, at least the engagement surface is chrome plated.

As discussed above, the front adjuster 540 preferably is threaded, and thus its effective length can be adjusted by rotating the adjuster, thus threadingly advancing or retracting the front adjuster 540. Preferably, such adjustment is made to fine-tune the length of the arm after initial manufacturing in order to optimize the geometrical operation of the arm and spring 138*b*. Preferably, once adjusted during manufacture, the front adjuster 540 will not need further adjustment by the user of the instrument. However, some users may wish to further adjust, or even routinely adjust, this component. In other embodiments, this portion of the arm is integrally formed therewith, and is not adjustable.

With continued reference to FIGS. 24A, 24B and 25, preferably an adjustment bolt 560 is supported by the body 142*b*. In the illustrated embodiment, an upper portion of the bolt 560 is supported for rotation by a ball bearing 562 held in place by a clip 564, and a lower portion is supported for rotation by a block 564 that is secured within the body 142*b*. A knob portion 568 of the bolt 560 extends outwardly from the body 142*b* so as to be operable by a user. Preferably, the shank portion 570 of the bolt 560 is threaded with threads that are sized and adapted to accommodate the hooked second end 524 of the spring 138*b*. In a preferred embodiment, the spring mount threads 570 are configured to minimize friction between the spring 138*b* and the threads 570. Most preferably, the threads 570 comprise a hardened material having a hardness of, for example, between about 55-62 HRC.

During operation, as the knob 568 of the adjustment bolt 560 is rotated, the second end 524 of the spring 138*b* is moved up or down, effectively and substantially changing the angle of attack of the spring 138*b* and thus changing the tension actually applied to the musical string 50 supported by the string tensioner 135*b*. In this manner, to string the instrument, the string 50 is first put in place and tightened to near-correct tune by the knobs 48 on the head 36. Then the knob 560 of the string tensioner 135*b* is rotated so as to fine-tune the tension applied to the string in order to attain perfect string tune.

In the illustrated embodiment, each string tensioner 135*b* is configured to support only one musical string 50. Preferably, an instrument, such as a guitar, that comprises several strings will have a corresponding number of string tensioners. Most preferably, the plurality of string tensioners are arranged in a modular arrangement in which individual modules (string tensioners) are substantially independent of other modules on the instrument. As such, individual modules can be independently installed, moved and adjusted.

With additional reference to FIG. 27, preferably a mount member 574 extends rearwardly from the body 142*b* of the string tensioner 135*b*. In the illustrated embodiment, the mount member 574 is generally tube-shaped and comprises a threaded inner portion. The string tensioner mount member 574 helps maintain the string tensioner in position relative to the guitar surface 530.

In a preferred embodiment, the guitar comprises a mount flange 580 or other mounting mechanism configured to support a bolt 582 that can engage the string tensioner mount member 574. In the illustrated embodiment, the bolt 582 extends through the mount flange 580 and engages the threaded inner surface of the mount member 574. Preferably, the bolt 582 has a head 584 that a user can manipulate to rotate the bolt 582. The linear position of the string tensioner 135*b* relative to the guitar body is adjusted by twisting the head 584 of the mount bolt 582, thus moving the string tensioner closer or further from the flange 580. As such, a player can customize the placement of the string tensioner 135*b* to improve tuning. Further, because of the preferred modular arrangement, individual string tensioners can be adjusted substantially independent of the other string tensioners.

As just discussed, the illustrated mount configuration enables the position of the string tensioner 135*b* to be adjusted longitudinally along the face 530 of the instrument by rotating the bolt 582 that engages the mount member tube 574. As such, when the module 135*b* is in place and supporting a string 50 under tension, the bolt 582 can be rotated to longitudinally move the module 135*b*, and thus change the playing length of the string 50. This feature is especially advantageous when adjusting a string's intonation. When adjusting for intonation, a musician seeks to determine the ideal playing length of the string so that the string is in correct tune all the way along its length. The present configuration enables intonation to be adjusted while the instrument is strung and under tension. Also, the modular arrangement enables each string tensioner 135*b* to be individually positioned, and each string 50 can have a unique, custom-adjusted playing length.

In the illustrated embodiment, the string tensioner module 135*b* is adapted to be positioned on or above the face 530 of the instrument as illustrated in FIG. 27. Thus, the face 530 of the instrument is substantially unaffected by the string tensioner module 135*b*. As such, the present modules can be installed without, for example, cutting away a part of the wood of the instrument face. In another embodiment, a module 135*b* may rest on the face 530 of the instrument, and in still other embodiments a module may be connected to the face of the instrument by, for example, a fixed connection or by a slidable connection that allows the module to move longitudinally (so as to allow intonation adjustments). It is to be understood that other methods and structure for linearly adjusting the positions of the modules can be employed as well.

With particular reference to FIGS. 24A, 25 and 27, the arrangement in which the saddle 500 supports the string 50 from a position opposite the instrument's surface 530, and in which the anchor portion 502 extends generally away from the instrument surface 530, provides further benefits in providing for a tremolo effect. More specifically, during play a user can create a tremolo effect by, for example, pushing and/or pulling on the anchor portion 502, thus rotating the force modulating member 140*b* about the pivot 182*b* sufficient to change the tension, and consequently the tone, of the string 50 to create a tremolo effect. In an embodiment employing one string tensioner per string, the tremolo effect may be accomplished with each string individually. However, the user may also engage multiple anchor portions simultaneously so as to create a tremolo effect involving some or even all of the strings.

In embodiments discussed above in connection with FIGS. 2-4, the springs 71 generally directly exert their spring force to the corresponding strings 50 without a force modulating member disposed between the spring and string. In the embodiments discussed above in connection with FIGS. 5-12, the springs 138 exert their spring force to the corresponding strings 50 through a force modulating member. As discussed above, force modulating members of various shapes, sizes and configurations are contemplated. Applicants contemplate that aspects of the present inventions can be advantageously employed both through embodiments having direct spring-to-string force application and through embodiments in which spring force is modulated while being communicated to the string. In a particularly preferred embodiment, the spring force application is such that as the string elongates, the springs maintain tension so that the string remains within an acceptable range of tone relative to perfect-tune. In another preferred embodiment, as the string elongates, the spring continues to apply tension so that string tune changes relatively slowly as compared to a traditional instrument. Such slowing of the process of going out of tune is valuable, even though preserving near-perfect tune is preferred.

The discussion below establishes certain mathematical relationships that may be considered when developing embodiments employing springs to supply a tension to a corresponding musical string, which tension preferably is relatively slow-changing upon stretching of the string over time and more preferably is generally constant notwithstanding stretching of the string over a range.

Certain Mathematical Equations Include:

1) frequency of vibrating string: $=(\frac{1}{2}L)(T/d)^{1/2}$.

where

L is the length of the string;

T is the string tension; and d is the string diameter

2) Young's modulus of elasticity: $\rho=FI/(Ax)$ where $\rho$ is the modulus of elasticity;

F is the force along some axis Z of the material;

I is the natural length along the same axis Z of the material;

A is the cross sectional area of the material along axis Z; and x is the linear displacement (the stretch).

3) $F=-Kx$.

where

K is the spring constant, or spring rate, of the spring.

Rearranging equation 2 we get $F=(\rho A/I)x$, which is equation 3 where $\rho A/I=K$. For steel, $\rho$ is about 30,000,000 lbs./in.^2; for nylon, $\rho$ is about 1,500,000 lbs./in.^2. As such, steel is about 20 times stiffer then nylon. However, nylon strings will have a wider cross sectional area compared with steel strings because, as equation 1 shows, density is a variable in the emitted frequency. The density of steel is about 0.28 lbs./in.^3 the density of nylon is about 0.04 lbs./in.^3. Thus, the cross sectional area of a nylon string is about 7 times that of a steel string (0.28/0.04) if we are to keep the mass per unit length density (as used in equation 1) of the steel and nylon strings substantially the same. If the density of the strings is held constant, the same length string under the same tension will emit the same frequency.

Since K is proportional to the cross sectional area, the "stretchiness" of a nylon string with the same mass per unit length of a steel string will be 20/7 (~3 times) that of a steel string. Put another way, $K_{nylon}=(7/20)K_{steel}$.

In a typical guitar, the nominal string diameter of the steel high E string (the stretchiest string) is about 0.009" in diameter, and the maximum natural length of this string is about 40". From these parameters, we can calculate that the spring constant for this string is about 30,000,000*(0.009/2)^2*PI/40=47.71 lb./in. for steel, and about 47.71/(20/7)=16.7 lb./in. for nylon. The ultimate strength of steel is about 213,000 lbs./in.^2; thus a steel high E string will likely fail if stretched more than about 213,000*PI*(0.009/2)^2=13.5 lbs. Maximum deflection of the E string at this maximum tension is 13.5 lbs./(47.71 lbs./in.)=0.28 inches which is, for a typical 40" guitar string, about 0.7% elongation.

Similarly, based on these assumptions and calculations, the stretchiest string (E) of the stretchiest material (nylon) of a conventional guitar will stretch about 0.28*(20/7)=0.81 inches or about ¾" which is, for a typical 40" guitar string, about 1.9% elongation.

An additional embodiment has a structure generally similar to those disclosed above in connection with FIGS. 2-4, but may have varying relative dimensions. One such embodiment has a spring constant of about 1 lb./in. For a steel E string that deflects 0.28 inches at 13.5 lbs. of tension, the change in tension pursuant to equation 3 is 0.28 lb. Thus, the changed tension applied by the spring will be 13.22 lbs. Since, when other factors are held constant, the frequency of a string changes with the square root of the tension, the frequency can be expected to change about 1%, remaining about 99% of the original frequency. By the same reasoning, using a spring having a rate of about 2 lb./in. yields a frequency about 98% of the original frequency. Similar calculations determine the following additional relationships: a spring rate of 0.5 lb./in. yields a frequency about 99.5% of the original frequency; a spring rate of 0.25 lb./in. yields a frequency about 99.7% of the original frequency; and a spring rate of 0.1 lb./in. yields a frequency about 99.9% of the original frequency. Further, although this discussion contemplates a directly connected embodiment such as in FIGS. 2-4, using a force modulating member can further soften spring rates to even further lessen the frequency differences with a change in string elongation.

In the 12-tone musical scale, moving down a full step (note) is achieved at a frequency that is $2^{(-2/12)}=0.89$ times the original note. Thus, a pitch emitted within about 90% of the original frequency of a tuned string is within about 1 full step of the original pitch.

Further to the above discussion, spring arrangements can be chosen so that even larger string elongations, such as elongation by one or two inches (of a 40 in. guitar string), results in a frequency that is still 90% or more of the original, perfect-tune frequency.

In yet another embodiment, a constant torque spring motor, such as the NEG'ATOR product discussed above, or a constant force-type spring, is coupled with a string so as to apply a near-constant force even during elongation of the spring by several inches. As such, even if the spring operates on a lever arm, the change in spring tension is very small even if the string were to elongate 1, 2 or more inches, and substantially negligible for the relatively small stretch anticipated during use.

In a still further embodiment, musical string is constructed of wire manufactured according to very tight tolerances. For example, preferably a string that is adapted to be the high E string of a guitar has a nominal diameter of about 0.009 inches, and a diameter tolerance of less than 0.5%, more preferably less than 0.25%, and most preferably below 0.1%. As such, consistency of actual natural frequency of the string at a specified tension and effective length is achieved. For example, the guitar high E string nominally vibrates at 330 Hz. Applicant has determined that a string diameter that varies from the nominal diameter by +−0.25% will vibrate at between 329.175 and 330.825 Hz, which corresponds to about 1.65 beats per second. Adherence to 0.1% diameter tolerances will result in under 0.66 beats per second, which is an inaudible difference in tune. Preferably, manufacturing tolerances are such that the variation from nominal frequency generates a beat frequency of less than about 2 beats per second, more preferably less than about 1.65 beats per second, still more preferably less than about 1 beat per second, and most preferably about 0.66 beats per second or less.

In connection with a tight-tolerance string, an embodiment may employ a spring having similarly tight-tolerances joined end-to-end with the string. As such, substantially no adjustments will be necessary. In such an embodiment, indicia may be provided adjacent the spring/string connection to indicate the actual tension of the string. Thus, when mounting the string on the instrument, the user tightens the tuning knob until the spring/string connection aligns with the appropriate indicia mark. Also, if the string is to change in length due to relaxation or the like, the user may adjust the tuning knob to realign the connection with the appropriate indicia mark.

It is also to be understood that embodiments described herein can be adapted to be used with strings of various sizes, tones, lengths and the like. For instance, different guitar strings typically have an ideal (perfect tune) tension between about 10-20 lb., and sometimes between about 10-30 lb. Certain relatively large piano strings are configured so that their perfect tune tension approaches 200 lb. and, if multiple strings are combined and powered by a single spring, such tension requirement may approach 1,000 lb. It is contemplated that certain musical strings may find a perfect tune tension at or even below 5lb. Applicants contemplate arranging embodiments to accommodate such ranges of string tensions.

Although the inventions disclosed herein have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations have been shown and described in detail, other modifications, which are within the scope of these inventions, will be readily apparent to those of skill in the art based upon this disclosure. For example, other structures than the threaded mount member tube of FIGS. 24-27 may be employed to mount a module onto an instrument so that the position of the module is longitudinally adjustable relative to the instrument face. It is also contemplated that various combinations or subcombinations of the specific features and aspects of the embodiments may be made and still fall within the scope of the inventions. Accordingly, it should be understood that various features and aspects of the disclosed embodiments can be combined with or substituted for one another in order to form varying modes of the disclosed inventions. For instance, lighting sources discussed in connection with FIGS. 2-4 may also be employed in connection with embodiments shown in FIGS. 5-12, 24-27, or any embodiments taught or suggested herein, and coil springs as shown in FIGS. 5-12, and 23-27 can be used in embodiments such as that shown in FIG. 22. Thus, it is intended that the scope of the present invention herein disclosed should not be limited by the particular disclosed embodiments described above, but should be determined only by a fair reading of the claims that follow.

What is claimed is:

1. A string mounting system for a stringed musical instrument that comprises a plurality of musical strings, the string mounting system comprising:

a plurality of string supports, each string support comprising a saddle and an anchor portion which are supported by a string support body, the saddle being configured to support a musical string, the anchor portion configured to engage an anchor of a musical string so as to hold the string securely under tension; and each string support body comprising a mount portion that secures the associated string support to a musical instrument and which interacts with the musical instrument through an adjustable connector, the mount portion and adjustable connector configured so that a linear position of the string support relative to a corresponding musical instrument can be selectively set and adjusted, and once set the support body maintains its linear position relative to the musical instrument during playing of the instrument until the adjustable connector is actuated;

wherein the plurality of string supports are configured to be arranged generally side by side and independently linearly movable relative to one another;

wherein linearly moving a string support selectively increases or decreases the effective playing length of a corresponding musical string; and wherein the saddle is attached to a mechanical interface that is adapted to pivot relative to the string support body, and a spring is interposed between the mechanical interface and the body.

2. A string mounting system as in claim 1, wherein the adjustable connector comprises a threaded bolt, and the mount portion extends generally rearwardly from the string support body and is configured to accept the threaded bolt that also engages a portion of the musical instrument, and wherein rotation of the threaded bolt changes the linear position of the mount portion and associated support body relative to the musical instrument.

3. A string mounting system as in claim 1, wherein the saddle is configured to support a musical string by engaging a side of the string that faces generally away from a surface of the musical instrument; and wherein the anchor portion of the string support extends generally away from a surface of the musical instrument so that the anchor portion is disposed farther from the surface of the musical instrument than is the saddle.

4. A string mounting system as in claim 3, wherein the string support is configured to be mounted onto a musical instrument without the string support penetrating a surface of the musical instrument.

5. A string mounting system as in claim 4, wherein the string support is adapted to be mounted generally on or above a surface of a musical instrument.

6. A string mounting system as in claim 3, wherein the saddle and the anchor portion are attached to a mechanical interface that is adapted to pivot relative to the string support body, and a spring is interposed between the mechanical interface and the body.

7. A string mounting system as in claim 1, wherein the adjustable connector is configured to control the linear position of the string support relative to the musical instrument so that the string support does not move linearly relative to the musical instrument except upon actuation of the adjustable connector.

8. A string mounting system for a stringed musical instrument that comprises a plurality of musical strings, the string mounting system comprising:

a plurality of string supports, each string support comprising a saddle and an anchor portion which are supported by a string support body, the saddle being configured to support a musical string, the anchor portion configured to engage an anchor of a musical string so as to hold the string securely under tension, the saddle being attached to a mechanical interface that is adapted to pivot relative to the string support body, and a spring is interposed between the mechanical interface and the body;

wherein the mechanical interface comprises a pivot, a first spring mount is disposed on the mechanical interface, a first end of the spring is attached to the first spring mount, and the first spring mount is spaced from the pivot so that force exerted by the spring acts upon a moment arm relative to the pivot, and wherein the moment arm changes as the mechanical interface rotates about the pivot; and each string support body comprising a mount portion that secures the associated string support to a musical instrument, the mount portion configured so that a position of the string support on a musical instrument can be selectively linearly adjusted;

wherein the plurality of string supports are configured to be arranged generally side by side and independently linearly movable relative to one another; and wherein linearly moving a string support selectively increases or decreases the effective playing length of a corresponding musical string.

9. A string mounting system as in claim 8, wherein the first spring mount comprises a spring engagement surface, and the spring engagement surface comprises a material having a hardness of about 55-62 HRC.

10. A string mounting system as in claim 9, wherein the spring engagement surface is chrome plated.

11. A string mounting system as in claim 9, wherein the first spring mount is selectively movable relative to the mechanical interface.

12. A string mounting system as in claim 11, wherein the first spring mount is elongate and threaded, and is configured to be threadingly attached to the mechanical interface, and wherein the first spring mount is configured so that the space between the pivot and the spring engagement surface can be selectively increased or decreased by rotating the first spring mount.

13. A string mounting system as in claim 12, wherein the saddle is configured to support the musical string on a side of the string opposite a surface of the musical instrument.

14. A string mounting system as in claim 13, wherein the anchor portion extends generally away from a surface of the musical instrument.

15. A string mounting system as in claim 9, wherein the spring engagement surface is defined by a first arc curving generally about a first axis and a second arc curving generally about a second axis transverse to the first, wherein the second arc translates along the first arc to define the spring engagement surface.

16. A string mounting system for a stringed musical instrument that comprises a plurality of musical strings, the string mounting system comprising:

a plurality of string supports, each string support comprising a saddle and an anchor portion which are supported by a string support body, the saddle being configured to support a musical string, the anchor portion configured to engage an anchor of a musical string so as to hold the string securely under tension, the saddle being attached to a mechanical interface that is adapted to pivot relative to the string support body, and a spring is interposed between the mechanical interface and the body;

wherein the mechanical interface pivots about the string support body at a pivot, a first end of the spring is attached to the mechanical interface at an interface attachment member, a second end of the spring is attached to the string support body at a body attachment member, and the body attachment member is actuable to selectively linearly change the position of the second end of the spring relative to the body, wherein the interface attachment member is spaced from the pivot, a line of action of the spring is spaced a moment arm distance from the pivot, and linearly changing the position of the second end of the spring changes the moment arm distance; and each string support body comprising a mount portion that secures the associated string support to a musical instrument, the mount portion configured so that a position of the string support on a musical instrument can be selectively linearly adjusted;

wherein the plurality of string supports are configured to be arranged generally side by side and independently linearly movable relative to one another; and wherein linearly moving a string support selectively increases or decreases the effective playing length of a corresponding musical string.

* * * * *